US007711301B2

(12) United States Patent
Takemoto et al.

(10) Patent No.: US 7,711,301 B2
(45) Date of Patent: May 4, 2010

(54) IMAGE TRANSFER DEVICE FOR IMAGE FORMING APPARATUS

(75) Inventors: Takeshi Takemoto, Kanagawa (JP); Takashi Seto, Kanagawa (JP); Katsuaki Miyawaki, Kanagawa (JP); Takashi Fujita, Kanagawa (JP); Hiromitsu Takagaki, Kanagawa (JP); Atsushi Nakafuji, Tokyo (JP); Shin Kayahara, Kanagawa (JP); Hirohmi Tamura, Kanagawa (JP); Kazumi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 175 days.

(21) Appl. No.: 11/683,086

(22) Filed: Mar. 7, 2007

(65) Prior Publication Data

US 2007/0212129 A1 Sep. 13, 2007

(30) Foreign Application Priority Data

Mar. 10, 2006 (JP) ..... 2006-065580
Mar. 20, 2006 (JP) ..... 2006-075921
Dec. 11, 2006 (JP) ..... 2006-332778

(51) Int. Cl.
*G03G 15/20* (2006.01)

(52) U.S. Cl. ..... 399/313; 399/302; 399/307; 399/66; 101/211

(58) Field of Classification Search ..... 399/302, 399/66, 69
See application file for complete search history.

(56) References Cited

U.S. PATENT DOCUMENTS 5,402,220 A 3/1995 Tanaka et al.
6,061,543 A 5/2000 Kayahara et al.
6,324,374 B1 11/2001 Sasamoto et al.
6,345,170 B1 2/2002 Nakazato et al.
6,489,020 B1 * 12/2002 Caruthers et al. ..... 428/327
6,604,461 B1 * 8/2003 De Bock et al. ..... 101/211
6,631,253 B2 10/2003 Nakafuji et al.

(Continued)

FOREIGN PATENT DOCUMENTS

JP 63-189878 8/1988

(Continued)

OTHER PUBLICATIONS

U.S. Appl. No. 12/042,143, filed Mar. 4, 2008, Kayahara, et al.

(Continued)

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An image transfer device provided in an image forming apparatus in which, employing an endless belt as an intermediate transfer member, image transfer is performed at nip positions of a primary transfer portion and secondary transfer portion. Generation of warp in the transferred image resulting from transmission of fluctuations in load and torque of the endless belt generated at the nip position of one transfer portion nip to the nip position of the other transfer portion is prevented. The endless belt is turned between rollers and the endless belt is individually driven at the primary transfer portion and secondary transfer portion by drive sources to generate deflection between the primary transfer portion and the secondary transfer portion.

32 Claims, 22 Drawing Sheets

U.S. PATENT DOCUMENTS

| | | | | |
|---|---|---|---|---|
| 6,697,595 | B2 | 2/2004 | Kawagoe et al. | |
| 6,760,564 | B2 * | 7/2004 | Oohara et al. | 399/302 |
| 6,795,678 | B2 | 9/2004 | Yura et al. | |
| 7,010,255 | B2 | 3/2006 | Yura et al. | |
| 7,031,648 | B2 | 4/2006 | Takashi et al. | |
| 7,054,585 | B2 | 5/2006 | Sasamoto et al. | |
| 7,127,202 | B2 | 10/2006 | Fujita et al. | |
| 2002/0034406 | A1 * | 3/2002 | Kawagoe et al. | 399/302 |
| 2002/0076227 | A1 * | 6/2002 | De Jong et al. | 399/66 |
| 2005/0019076 | A1 * | 1/2005 | Puckett et al. | 399/395 |
| 2005/0152721 | A1 | 7/2005 | Kikuchi et al. | |
| 2005/0201783 | A1 | 9/2005 | Kurotaka et al. | |
| 2005/0207801 | A1 * | 9/2005 | Kunii et al. | 399/307 |
| 2005/0271429 | A1 * | 12/2005 | Tachibana et al. | 399/301 |
| 2005/0286920 | A1 | 12/2005 | Baba et al. | |
| 2006/0008302 | A1 | 1/2006 | Someya et al. | |
| 2006/0013624 | A1 | 1/2006 | Kurotaka et al. | |
| 2006/0019082 | A1 | 1/2006 | Kikuchi et al. | |
| 2006/0051141 | A1 * | 3/2006 | Nowak et al. | 399/322 |
| 2006/0140689 | A1 | 6/2006 | Echigo et al. | |

FOREIGN PATENT DOCUMENTS

| | | |
|---|---|---|
| JP | 4-109285 | 4/1992 |
| JP | 4-360179 | 12/1992 |
| JP | 6-308839 | 11/1994 |
| JP | 10-268595 | 10/1998 |
| JP | 11-231677 | 8/1999 |
| JP | 2000-89601 | 3/2000 |
| JP | 3042414 | 3/2000 |
| JP | 2001-92274 | 4/2001 |
| JP | 2001-296764 | 10/2001 |
| JP | 3294342 | 4/2002 |
| JP | 2002-214930 | 7/2002 |
| JP | 2002-268325 | 9/2002 |
| JP | 2002-278311 | 9/2002 |
| JP | 2002-304080 | 10/2002 |
| JP | 2003-316176 | 11/2003 |
| JP | 3514134 | 1/2004 |
| JP | 2004-145260 | 5/2004 |
| JP | 2005-189693 | 7/2005 |
| JP | 2005-202113 | 7/2005 |
| JP | 2005-309227 | 11/2005 |

OTHER PUBLICATIONS

U.S. Appl. No. 12/164,921, filed Jun. 30, 2008, Suzuki et al.
U.S. Appl. No. 12/144,078, filed Jun. 23, 2008, Kayahara et al.
U.S. Appl. No. 12/144,267, filed Jun. 23, 2008, Yasutomi, et al.

* cited by examiner

IMAGE TRANSFER DEVICE FOR IMAGE FORMING APPARATUS

BACKGROUND OF THE INVENTION

1. Field of the Invention

The present invention relates to an image forming apparatus such as a copier, printer, facsimile device, printing press or composite machines thereof, and more particularly to an image transfer device of a type for forming an electrostatic latent image on an image carrier and performing a primary transfer of a toner image obtained by developing this electrostatic latent image onto an endless belt serving as an intermediate transfer member at a primary transfer portion, that is to say, a primary transfer nip position, and performing a secondary transfer of the toner image that has been primary transferred onto the endless belt onto a recording medium, such as a sheet, carried to a secondary transfer portion, that is to say, a secondary transfer nip position.

2. Description of the Related Art

While a seamless, endless belt is preferably employed as the intermediate transfer member in the image transfer device employed in this kind of image forming apparatus, for reasons of cost a seamed, endless belt is commonly employed. However, because the seam of a seamed, endless belt protrudes therefrom, undesirable load and torque fluctuations attributable to this protruding section are generated as the belt is moved when the seam passes the primary transfer nip position and the secondary transfer nip position. These fluctuations affect the movement of the belt and cause a change in the moving speed that leads to unstable belt movement.

On the other hand, when the front-end portion of the sheet serving as the recording medium P (particularly in the case of a thick sheet (extra thick paper)) goes into the secondary transfer nip position and the rear-end portion thereof comes out of the secondary transfer nip position, load and torque fluctuations attributable to the thickness of the recording medium P that which cause unstable belt movement occur. Because these fluctuations are transferred by way of the endless belt to the primary transfer portion, that is to say, the primary transfer nip portion, fluctuations in the correct transfer position are produced at the primary transfer nip position resulting in generation of a so-called shock jitter. Accordingly, warp leading to unsatisfactory image production is generated in the toner image transferred onto the sheet.

The fluctuations affecting the stable movement of the endless belt are attributable to several other factors apart from the protruding seam of the endless belt and the employment of a thick recording medium P such as extra thick paper. These include, for example, minute belt slip caused by load and torque fluctuations, belt stretching, deflection during rotation at the joint mechanism or gear portion serving as the decelerator mechanism of the transmission system and, furthermore, inability of the retention force of the drive motor to withstand the load and torque fluctuations.

Increasing the output of the drive sources for driving the endless belt and improving the drive transmission rigidity of the decelerator for transmitting the drive force of the drive sources have been considered as means to obviate the various problems inherent to the prior art described above. Turning of an endless belt around a tension roller urged by a spring or the like of a conventional image forming apparatus and movement of the position of the tension roller to absorb torque fluctuation so as to alleviate shock has been proposed (for example, Japanese Patent No. 3,294,342 and Japanese Laid-open Patent Application No. H06-115752).

However, concerns exist regarding the increased size and weight and so on of the apparatus and associated increase in costs that results from increasing the output of the drive force and improving the drive transmission rigidity of the decelerator. In addition, in apparatus in which the endless belt is turned around a tension roller, when the mass of the member for absorbing shock is increased a drop in responsivity and inability to withstand high-frequency sudden load fluctuation occurs and, accordingly, the desired improvement cannot be achieved.

On the other hand, image forming apparatuses that utilize a system based on integrated configuring of a section from a secondary transfer portion to a fixing portion have been proposed in recent years with a compacting of the apparatuses and improved reliability of the sheet carry thereof being achieved as a result (for example, Japanese Laid-open Patent Application Nos. H10-63121 and 2004-145260).

However, there is a problem inherent to these image forming apparatuses in that, because the load fluctuation that occurs when the front-end portion and rear-end portion of the extra thick paper serving as the recording medium P pass through the fixing nip portion is transferred by way of the intermediate transfer belt to the primary transfer nip position, the shock jitter described above which leads to generation of warp in the transfer image occurs.

Technologies relating to the present invention are disclosed in, for example:

Japanese Patent No. 3,042,414,
Japanese Patent No. 3,514,134,
Japanese Laid-open Patent Application. No. S63-189878,
Japanese Laid-open Patent Application. No. H04-360179,
Japanese Laid-open Patent Application. No. H06-308839,
Japanese Laid-open Patent Application. No. H10-268595,
Japanese Laid-open Patent Application. No. H11-231677,
Japanese Laid-open Patent Application. No. 2000-089601
Japanese Laid-open Patent Application. No. 2001-092274,
Japanese Laid-open Patent Application. No. 2001-296764,
Japanese Laid-open Patent Application. No. 2002-268325,
Japanese Laid-open Patent Application. No. 2002-278311,
Japanese Laid-open Patent Application. No. 2002-304080
and
Japanese Laid-open Patent Application. No. 2005-309227.

SUMMARY OF THE INVENTION

An object of the present invention is to provide an image transfer device for an image forming apparatus of a type performing image transfer at nip positions of a primary transfer portion and secondary transfer portion employing an intermediate transfer member such as an endless belt, wherein transfer of fluctuations in load and torque of an endless belt generated at the nip position of one transfer portion to the nip position of the other transfer portion whereby the generation of warp in the transferred image can be effectively prevented.

In an aspect of the present invention, an image transfer device is provided in which an image carried on image carrier is primary transferred at a first transfer nip onto an endless belt configured from endless belt device and supported by a support member and in which the image primary transferred onto the endless belt is secondary transferred at a second transfer nip by secondary transfer device. Deflection is generated in the endless belt between the first transfer nip and the second transfer nip, and the endless belt is driven at the first transfer nip and the second transfer nip individually.

In another aspect of the present invention, an image transfer device is provided in which an image carried on image carrier is primary transferred at a first transfer nip onto an endless belt configured from endless belt device and supported by a support member and in which the image primary transferred onto the endless belt is secondary transferred at a second transfer nip by secondary transfer device. Deflection is generated in the endless belt between the first transfer nip and the second transfer nip to prevent torque fluctuation generated at one transfer nip when the endless belt is moved from affecting the other transfer nip.

In another aspect of then present invention, an image transfer device is provided in which an image carried on image carrier is primary transferred at a first transfer nip onto an endless belt configured from endless belt device and supported by a support member, and in which the image primary transferred onto the endless belt is secondary transferred at a second transfer nip by secondary transfer device. Deflection is generated in the endless belt between the first transfer nip and the second transfer nip to an extent that torque fluctuation generated at one transfer nip when the endless belt is moved can be absorbed.

In another aspect of the present invention, an image transfer device is provided in which an image carried on image carrier is primary transferred at a first transfer nip onto an endless belt configured from endless belt device and supported by a support member, and in which the image primary transferred onto the endless belt is secondary transferred at a second transfer nip by secondary transfer device. Belt length of the endless belt between one transfer nip and the other transfer nip is varied at the upstream side and downstream side of the transfer nips in the direction of movement of the endless belt to an extent that torque fluctuation generated at one transfer nip when the endless belt is moved can be absorbed.

In another aspect of the present invention, an image forming apparatus has an image transfer device in which an image carried on image carrier is primary transferred at a first transfer nip onto an endless belt configured from endless belt device and supported by a support member and in which the image primary transferred onto the endless belt is secondary transferred at a second transfer nip by secondary transfer device. Deflection is generated in the endless belt between the first transfer nip and the second transfer nip, and the endless belt is driven at the first transfer nip and the second transfer nip individually.

In another aspect of the present invention, a method of image transfer comprises the steps of: forming a first transfer nip by endless belt device comprising an endless belt and image carrier; forming a second transfer nip by the endless belt device and other device; driving a roller serving as a belt support member for turning the endless belt by a drive source dedicated for the endless belt device to move the endless belt at each of the first transfer nip and the second transfer nip individually; varying the speed at which the endless belt is moved at the first transfer nip and the speed at which the endless belt is moved at the second transfer nip to generate deflection in the endless belt between the first transfer nip and the second transfer nip; performing primary transfer, at the first transfer nip, of an image carried by the image carrier onto the endless belt of the endless belt device; and performing secondary transfer, at the second transfer nip, of the image carried by the endless belt.

In another aspect of the present invention, a method of image transfer comprises the steps of: forming a first transfer nip by endless belt device comprising an endless belt and image carrier; forming a second transfer nip by the endless belt device and other device; driving a roller serving as a belt support member for turning the endless belt of the endless belt device by a drive source dedicated for the endless belt device to move the endless belt at either the first transfer nip or the second transfer nip; transmitting a drive force from the exterior by an external drive source for the endless belt device to move the endless belt at either the first transfer nip or the second transfer nip so as to vary the speed at which the endless belt is moved at the first transfer nip and the speed at which the endless belt is moved at the second transfer nip, and generate deflection in the endless belt between the first transfer nip and the second transfer nip; performing primary transfer, at the first transfer nip, of an image carried by the image carrier onto the endless belt of the endless belt device; and performing secondary transfer, at the second transfer nip position, of the image carried by the endless belt.

In another aspect of the present invention, a method of image transfer comprises the steps of: forming a first transfer nip by endless belt device comprising an endless belt and image carrier; forming a second transfer nip by the endless belt device and other device; transmitting a drive force from the exterior by an external drive source for the endless belt device to move the endless belt of the endless belt device at each of the first transfer nip and the second transfer nip individually; varying the speed at which the endless belt is moved at the first transfer nip and the speed at which the endless belt is moved at the second transfer nip to generate deflection in the endless belt between the first transfer nip and the second transfer nip; performing primary transfer, at the first transfer nip, of an image carried by the image carrier onto the endless belt of the endless belt device; and performing secondary transfer of the image carried by the endless belt at a secondary transfer nip position.

In another aspect of the present invention, a method of forming deflection is provided in which deflection is formed in an endless belt of endless belt device supported by a support member between a primary transfer nip position and a secondary transfer nip position of an image transfer device. The speed at which the endless belt is moved at the first transfer nip and the speed at which the endless belt is moved at the second transfer nip are different from each other.

In another aspect of the present invention, a transfer device comprises an image carrier on which a toner image is carried: an opposing member provided opposite to the image carrier to form a nip portion; and a rotating member that abuts the image carrier at a downstream side of the nip portion and rotates at a speed higher than the drive speed of the image carrier in the same direction, whereby the toner image is transferred onto a recording medium passing through the nip portion.

In another aspect of the present invention, a transfer fixing device comprises a transfer fixing member onto which a toner image is transferred: an opposing member provided opposite to the transfer fixing member to form a nip portion; and a rotating member that abuts the transfer fixing member at a downstream side of the nip portion and rotates at a speed higher than the drive speed of the transfer fixing member in the same direction, whereby the toner image is fixed onto a recording medium passing through the nip portion.

In another aspect of the present invention, an image forming apparatus is provided with a transfer device. The transfer device comprises an image carrier on which a toner image is carried: an opposing member provided opposite to the image carrier to form a nip portion; and a rotating member that abuts the image carrier at a downstream side of the nip portion and rotates at a speed higher than the drive speed of the image carrier in the same direction, whereby the toner image is transferred onto a recording medium passing through the nip portion.

In another aspect of the present invention, an image forming apparatus is provided with a transfer fixing device. The transfer fixing device comprises a transfer fixing member onto which a toner image is transferred: an opposing member provided opposite to the transfer fixing member to form a nip portion; and a rotating member that abuts the transfer fixing member at a downstream side of the nip portion and rotates at a speed higher than the drive speed of the transfer fixing member in the same direction, whereby the toner image is fixed onto a recording medium passing through the nip portion.

In another aspect of the present invention, a transfer method uses a transfer device. The transfer device comprises an image carrier on which a toner image is carried: an opposing member provided opposite to the image carrier to form a nip portion; and a rotating member that abuts the image carrier at a downstream side of the nip portion and rotates at a speed higher than the drive speed of the image carrier in the same direction, whereby the toner image is transferred onto a recording medium passing through the nip portion.

In another aspect of the present invention, a transfer fixing method uses a transfer fixing device. The transfer fixing device comprises a transfer fixing member onto which a toner image is transferred: an opposing member provided opposite to the transfer fixing member to form a nip portion; and a rotating member that abuts the transfer fixing member at a downstream side of the nip portion and rotates at a speed higher than the drive speed of the transfer fixing member in the same direction, whereby the toner image is fixed onto a recording medium passing through the nip portion.

In another aspect of the present invention, an image forming method has a latent image forming step for forming a latent image on an image carrier and an image developing step for developing the latent image on the image carrier, and uses a transfer device. The transfer device comprises an image carrier on which a toner image is carried: an opposing member provided opposite to the image carrier to form a nip portion; and a rotating member that abuts the image carrier at a downstream side of the nip portion and rotates at a speed higher than the drive speed of the image carrier in the same direction, whereby the toner image is transferred onto a recording medium passing through the nip portion.

In another aspect of the present invention, an image forming method has a latent image forming step for forming a latent image on an image carrier and an image developing step for developing the latent image on the image carrier, and uses a transfer fixing device. The transfer fixing device comprises a transfer fixing member onto which a toner image is transferred: an opposing member provided opposite to the transfer fixing member to form a nip portion; and a rotating member that abuts the transfer fixing member at a downstream side of the nip portion and rotates at a speed higher than the drive speed of the transfer fixing member in the same direction, whereby the toner image is fixed onto a recording medium passing through the nip portion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
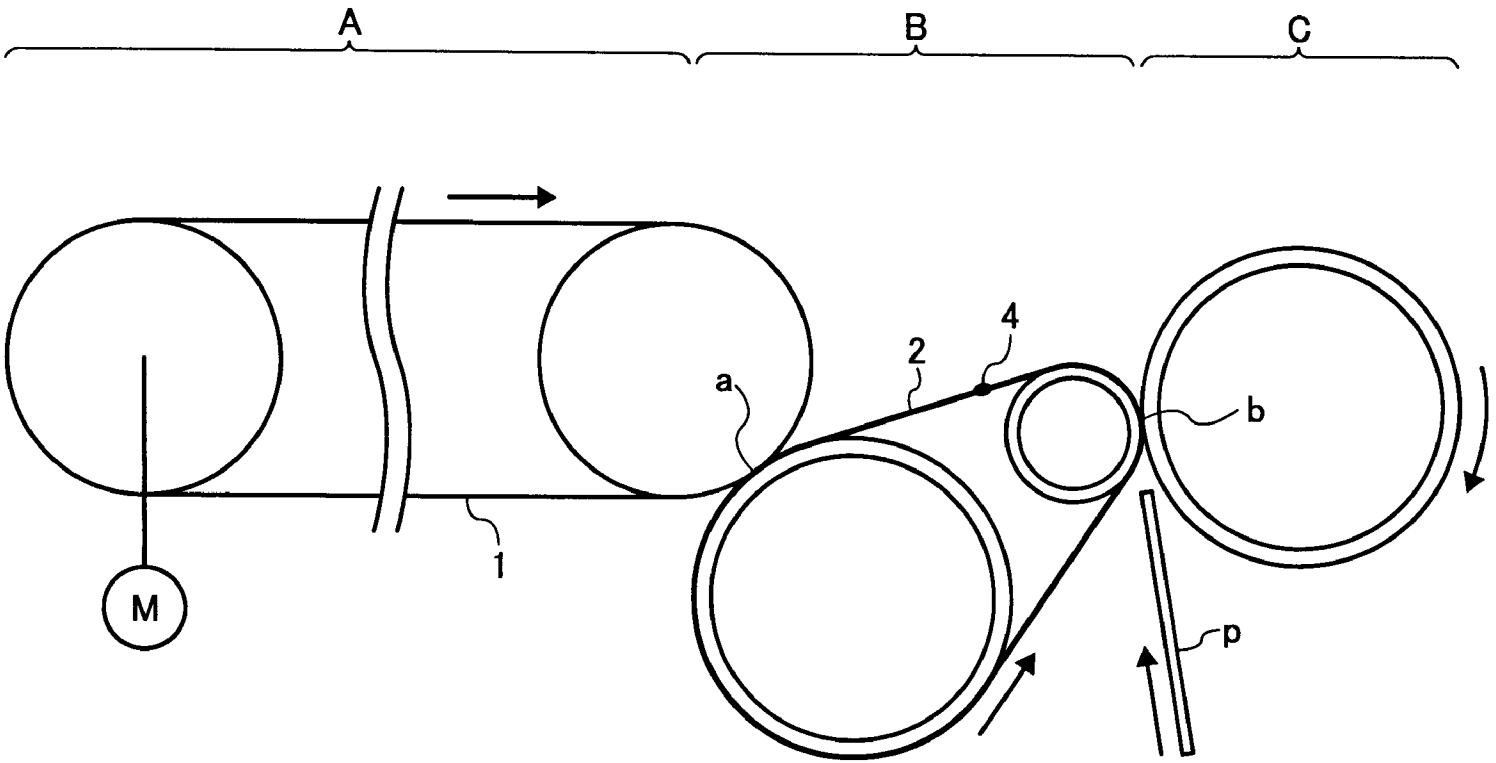
FIG. 1 PRIOR ART
FIG. 1 is a diagram showing schematically the configuration of an image transfer device of a conventional image forming apparatus.

Preferred embodiments of the present invention will be described hereinafter. It is to be noted that the reference numbers used in each embodiment are independent of the reference numerals of other embodiments, i.e., the same reference numerals do not always designate the same structural elements.

First Embodiment

The description of this embodiment is based on a description of the prior art pertaining to this embodiment as given hereinafter with reference to the drawings.

In modern electrophotographic-type image forming apparatuses an electrostatic latent image is formed on a photoconductive drum or photoconductive belt, the electrostatic latent image is visualized and formed as a toner image by fixing of toner by a developing device, the toner image is primary transferred onto an endless belt-like intermediate transfer member, and the toner image primary transferred onto this intermediate transfer member is secondary transferred onto a recording medium P such as blank paper or an OHP film or the like. For example, as shown in FIG. 1, an image is transferred from a photoconductive belt 1 to a recording medium P by primary transfer of a toner image carried on the photoconductive belt 1 of an image carrier device A onto an endless belt (intermediate transfer member) 2 of an intermediate transfer device B at a primary transfer nip position a, and secondary transfer of the image supported on the endless belt 2 by a secondary transfer device C onto a recording medium P such as a sheet carried in the direction shown by the arrow at a secondary transfer nip position b.

The use of a seamless-type endless belt 2 in an image forming apparatus such as this is very expensive and, accordingly, from the viewpoint of cost reduction, the use of an endless belt 2 with a seam 4 is preferred. However, an problem inherent to the use of an endless belt 2 with seam 4 pertains to the protrusion formed by the seam 4 and the generation of load fluctuation which cause the moving speed of the endless belt 2 to change and inhibit the stable movement of the endless belt 2 as the seam 4 passes through the primary transfer nip position a and secondary transfer nip position b.

In addition, load fluctuation that cause the moving speed of the endless belt 2 to change and inhibit the stable movement of the endless belt 2 is similarly generated when the front end of the recording medium P goes into the secondary transfer nip position b and the rear end thereof comes out of the secondary transfer nip position b. An additional problem pertains to transfer of this disturbance to the stable movement to the primary transfer position a by way of the endless belt 2 which results in an image transfer disturbance and the generation of image warp such as the so-called shock jitter.

Although absorption of torque fluctuation to alleviate this shock based on increasing the output of the drive sources for driving the intermediate transfer device B, improving the drive transmission rigidity of the decelerator for decelerating the drive force of the drive sources, and turning the endless belt 2 around a tension roller urged by a spring or the like and moving the position of the tension roller have been hitherto implemented with a view to resolving these problems, a satisfactory resolution to the problems described above has not been achieved with these methods.

A first embodiment for resolving the problems described above will be described in detail hereinafter with reference to the drawings.

Figure 2:
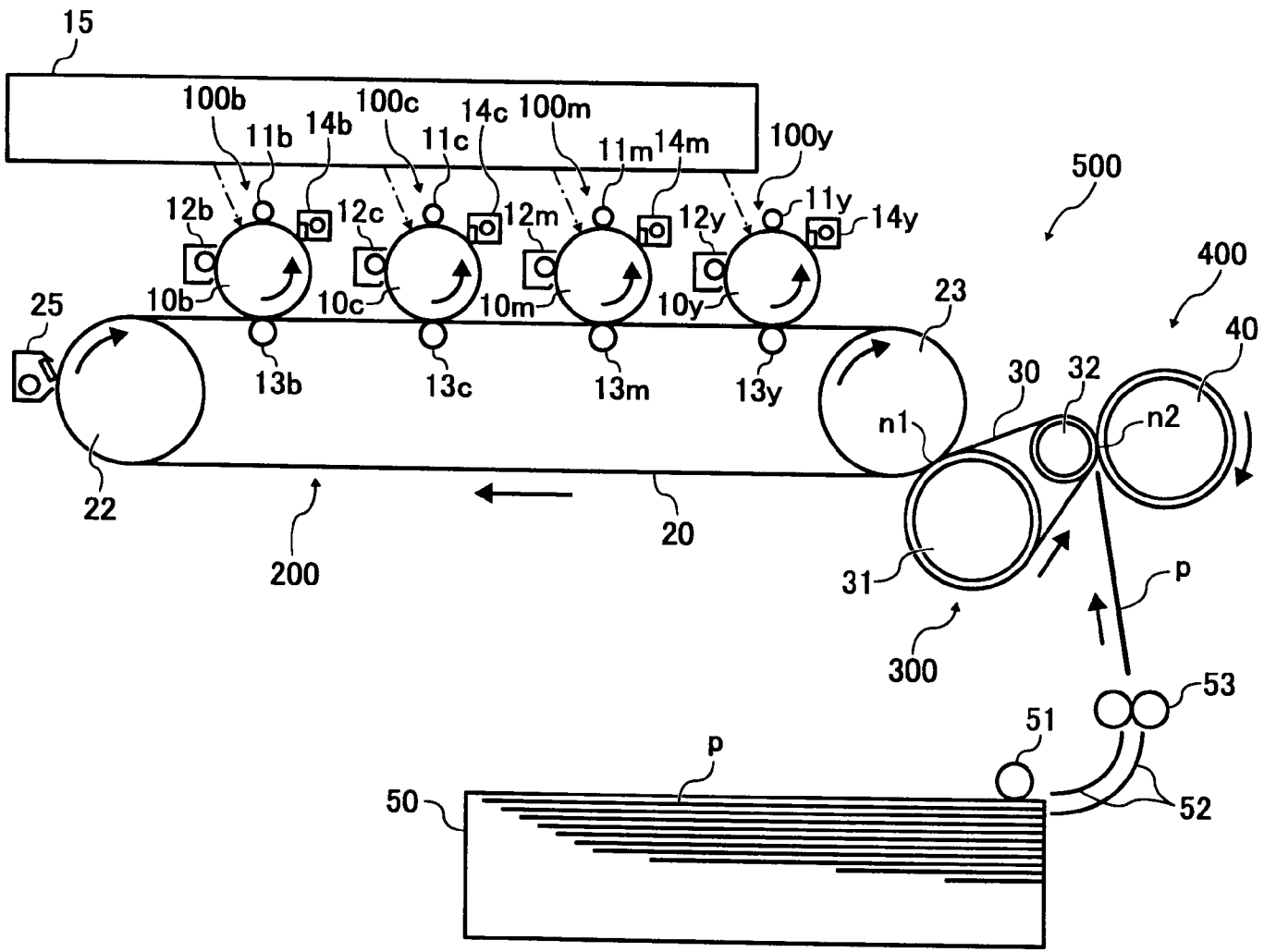
FIG. 2 is a diagram showing schematically the configuration of a main part of an image forming apparatus pertaining to a first embodiment of the present invention.

FIG. 2 shows a main part configuration of the internal mechanism of an image forming apparatus such as a copier, printer, facsimile device or combination copier-printer-fax device.

In the image forming apparatus shown in the diagram, toner images imaged on photoconductive drums 10*b*, 10*c*, 10*m*, 10*y* by a plurality of imaging devices 100*b*, 100*c*, 100*m*, 100*y* are transferred onto an intermediate transfer member 20 of an intermediate transfer device 200, the toner images on the intermediate transfer member 20 are transferred onto an endless belt 30 of an endless belt device 300, and the toner images on the endless belt 30 are transferred onto a recording medium p such as blank paper or OHP film by a secondary transfer device 400.

The imaging device 100 comprises four imaging devices 100*b*, 100*c*, 100*m*, 100*y* of colors black, cyan, magenta and yellow juxtaposedly provided in a tandem-type horizontal arrangement along the direction in which the intermediate transfer member 20 of the intermediate transfer device 200 extends. The photoconductive drums 10*b*, 10*c*, 10*m*, 10*y* are juxtaposedly provided in parallel with the imaging devices 100*b*, 100*c*, 100*m*, 100*y* and are similarly rotatable in the anticlockwise direction.

In addition, charging devices 11*b*, 11*c*, 11*m*, 11*y*, developing devices 12*b*, 12*c*, 12*m*, 12*y*, transfer devices 13*b*, 13*c*, 13*m*, 13*y* and photoconductive drum cleaning devices 14*b*, 14*c*, 14*m*, 14*y* are arranged around the photoconductive drums 10*b*, 10*c*, 10*m*, 10*y*. An exposure device 15 is provided above the four imaging devices 100.

As illustrated in the diagram, the endless belt-like intermediate transfer member 20 of the intermediate transfer device 200 is movable in the clockwise direction in the diagram turning between a drive roller 22 and driven roller 23. The roller-shaped transfer devices 13*b*, 13*c*, 13*m*, 13*y* are provided on the inner side of the intermediate transfer member 20 sandwiching the intermediate transfer member 20 together with the photoconductive drums 10*b*, 10*c*, 10*m*, 10*y*. In addition, as illustrated in the diagram, a transfer member cleaning device 25 for removing the residual toner remaining on the intermediate transfer member 20 following transfer is provided around the intermediate transfer member 20 on the left of the intermediate drive roller 22, and the endless belt device 300 is arranged to the lower right of the driven roller 23.

The endless belt device 300 is configured so that the endless belt 30 is turned between a large roller 31 and small 32 serving as belt support members. In addition, the large roller 31 is pushed against the driven roller 23 by way of the endless belt 30 and intermediate transfer member 20 forming a first transfer nip position n1 together with the intermediate transfer device 200 serving as the image carrier device. On the other hand, a pressure roller 40 of the secondary transfer device 400 is pushed from the exterior by way of the endless belt 30 against the small roller 32 forming a second transfer nip position n2 between the endless belt device 300 and secondary transfer device 400.

A recording material tray 50 in which a recording material p is housed in a ream, a supply roller 51 that upon contact with the front end of the uppermost recording material of the recording material p provided in a ream in the recording material tray 50 separates and pays out single sheets of the recording material p in sequence from the top, a guide member 52 for guiding the recording material p paid out by the supply roller 51, and a resist roller 53 that feeds the recording material p being guided by the guide member 52 to the second transfer nip position n2 at a set timing are provided below the intermediate transfer device 200 and endless belt device 300 described above.

In addition, for recording of a color image on the recording material p employing this image forming apparatus, each of the photoconductive drums 10 of the imaging devices 100, the intermediate transfer member 20 of the intermediate transfer device 200, the endless belt 30 of the endless belt device 300, and the supply roller 51 and so on are rotatably driven at an appropriate timing by, in the case of a copier, operation of a start switch not shown in the diagram, in the case of a printer in accordance with an image signal from a host, and in the case of a facsimile in accordance with an image signal sent by way of a telephone line.

In addition, accompanying the rotation of the photoconductive drums 10 the surface of the photoconductive drums 10 is uniformly decharged by a decharging device 11 whereupon, in accordance with a read signal from an original document read device or an image signal from a host or an image signal by way of a telephone line, writing is executed as a result of exposure of a writing light by the exposure device 15, electrostatic images are formed on the photoconductive drums 10, toner is individually affixed by the developer devices 12 to visualize the electrostatic latent images, and single color toner images of each of black, cyan, magenta and yellow are formed on the individual photoconductive drums 10.

The single color toner images on the photoconductive drums 10 are overlappingly transferred in sequence onto the intermediate transfer member 20 forming a synthesized color image on the intermediate transfer member 20 as a result of a predetermined transfer bias being imparted to each of the transfer devices 13. The original state of the photoconductive drums 10 is restored in preparation for subsequent image formation by removal of the residual toner remaining thereon following image transfer by photoconductive drum cleaning devices 14, and decharging by a decharging device not shown in the diagram.

A transfer electric field is formed in the transfer nip position n1 by imparting of a transfer bias that affords the electrostatic primary transfer of the synthesized color image on the intermediate transfer member 20 onto the endless belt 30. If overlap of the alternating component and pulse component of the transfer bias occurs at this time the electrostatic force acting on the toner oscillates and, as a result of this oscillation, the adhesive force of the toner weakens and the toner can be easily moved. The intermediate transfer member 20 is restored to its initial state in preparation for subsequent image transfer by removal of residual toner on the surface thereof following image transfer by a transfer member cleaning device 25.

Accompanying the rotation of the supply roller 51, the uppermost recording material p of the recording material p provided in a ream in the recording material tray 50 is separated and paid out in single sheets, and is then guided and carried by the guide member 52 and led to the second transfer nip position n2 by the resist roller 53 at a predetermined timing. A transfer bias is imparted to the pressure roller 40 of the secondary transfer device 400 at the second transfer nip position n2 and, as a result, the toner image carried on the endless belt 30 described above is transferred onto the recording material p passing through the second transfer nip position n2 and the color image is recorded on the recording material p.

While the description given above describes recording of a color image recorded on the recording material p, a color image or monochrome image can be arbitrarily formed by selective use of the imaging devices 100 of the image forming apparatus described above in accordance with a selected single color mode or plurality of colors mode.

Figure 3:
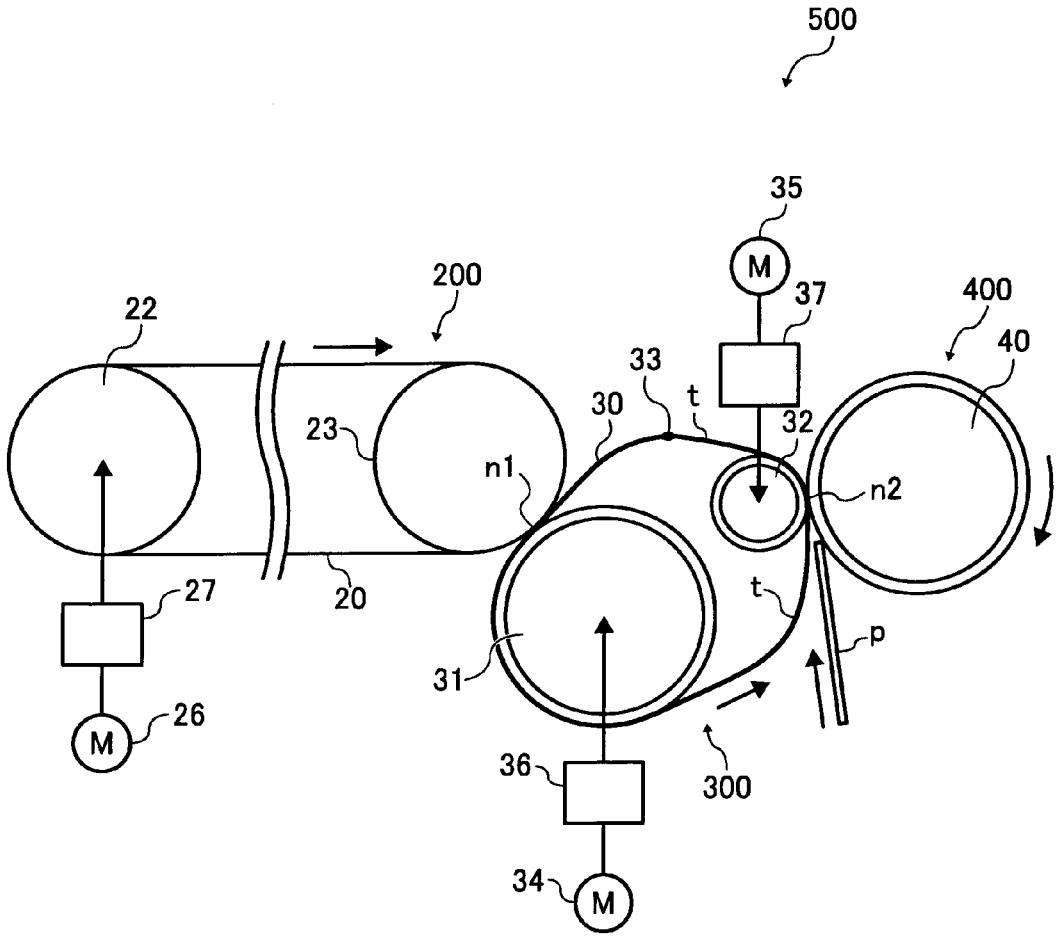
FIG. 3 is a diagram showing the configuration of an image transfer device provided in this image forming apparatus.

FIG. 3 shows an image transfer device 500 in which a toner image carried by the intermediate transfer member 20 of the intermediate transfer device 200 serving as the image carrier device is transferred onto the recording material p by way of the endless belt 30 of the endless belt device 300.

With cost reduction in mind, the image transfer device 500 in this diagram uses an endless belt 30 with seam 33 provided to turn between the large roller 31 and small roller 32 with deflection. The endless belt 30 is configured from a 3-layered structure of a polyimide base layer, a silicon rubber layer provided on this base layer, and a fluorine resin upper layer. Replacing the polyimide as the base layer, a metal such as nickel may be employed. In addition, a first drive source 34 and second drive source 35 serving as specialist drive sources for the endless belt device 300 are provided, the large roller 31 being rotationally driven by the first drive source 34 by way of a decelerator 36 and the small roller 32 being rotationally driven by the second drive source 35 by way of a decelerator 37, and the moving speed at the first transfer nip position n1 and the moving speed at the second transfer nip position n2 of the endless belt 30 being set as appropriate.

For example, the moving speed at which the endless belt 30 is moved at the second transfer nip position n2 is set slightly faster than the moving speed at which the endless belt 30 is moved at the first transfer nip position n1.

The torque fluctuation of the endless belt 30 when the recording material p goes into the second transfer nip position n2 is absorbed by the deflection t of the endless belt 30 at the downstream position of the second transfer nip position n2, and the torque fluctuation of the endless belt 30 when the recording material p comes out of the second transfer nip position n2 is absorbed by the deflection t of the endless belt 30 at the upstream position of the second transfer nip position n2. In addition, because the absorption of the deflection t is greater at the downstream position than the upstream position of the second transfer nip position n2, gradual decrease of the deflection t of the endless belt 30 at the downstream position is gradually corrected by making the moving speed at which the endless belt 30 is moved at the second transfer nip position n2 faster than the moving speed at which the endless belt 30 is moved at the first transfer nip position n1.

Accordingly, by the simple turning of the endless belt 30 between the large roller 31 and small roller 32 with deflection between the first transfer nip position n1 and second transfer nip position n2 and, in addition, the setting of the moving speed at the first transfer nip position n1 and the moving speed at the second transfer nip position n2 as appropriate, the effect of a torque fluctuation generated at one transfer nip position on the other transfer nip position can be prevented and, as a result, the need to increase the output of the drive sources of the image transfer device 500 and to improve the drive transmission rigidity of the decelerators 36, 37 and so on for relaying the drive force of the drive sources is eliminated and, in turn, concerns regarding the increased size and weight of the apparatus and the associated increased costs are alleviated.

In addition, the torque fluctuations of the endless belt 30 generated when the protruding seam 33 of the endless belt 30 passes through the nip positions n1 and n2 and when the recording material p goes into the second transfer nip position n2 and comes out of the second transfer nip position n2 and so on are absorbed by the deflection t generated in the endless belt 30, whereupon change in the moving speed of the endless belt 30 caused by these torque fluctuations and the effect of this change on the other transfer nip position can be effectively prevented to ensure elimination of the generation of image warp such as the so-called shock jitter.

In this example a third drive source 26 is provided in the intermediate transfer device 200 serving as the image carrier device, and a drive roller 22 is driven by the third drive source 26 by way of the decelerator 27 to move the intermediate transfer member 20. No drive source is provided in the secondary transfer device 400 and the pressure roller 40 is driven and rotated by the movement of the endless belt 30.

Figure 4A:
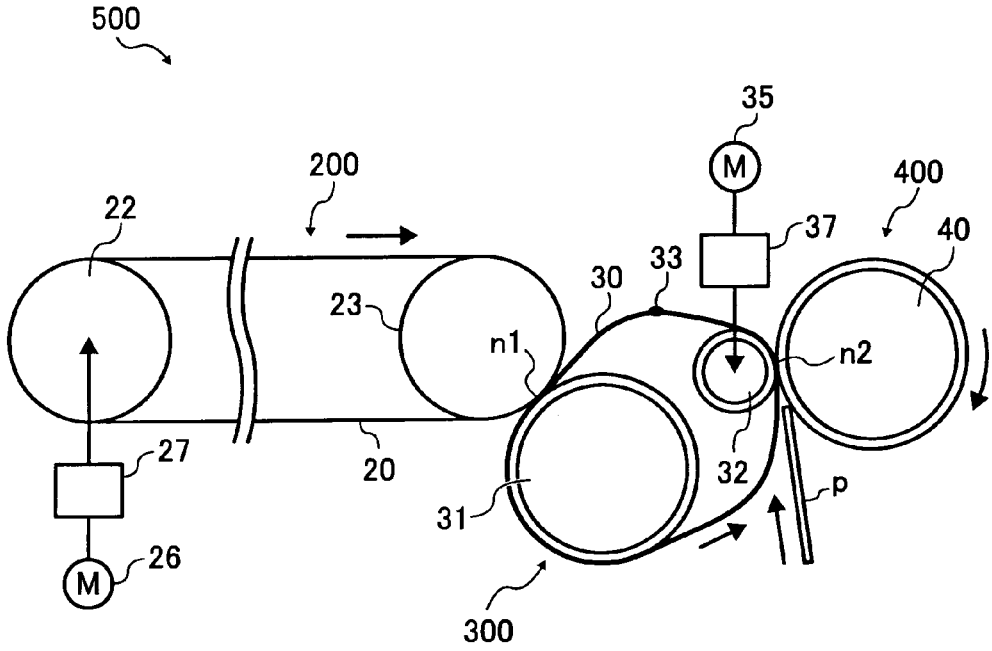
FIGS. 4A to 4C are diagrams each showing the configuration of modifications of this image transfer device.

In the example shown in FIG. 3 specialist drive sources 34, 35 are provided in the endless belt 300, the large roller 31 and small roller 32 being individually driven to move the endless belt 30 by the drive sources 34, 35. As shown in FIG. 4A, the first drive source 34 is dispensed with and drive force is transmitted to the endless belt 30 as a result of frictional contact thereof with the intermediate transfer member 20 moved by the third drive source 26, that is to say, drive force is able to be transmitted from the exterior to move the endless belt 30 at the first transfer nip position n1 employing the third drive source 26 provided in the exterior of the endless belt 300.

Figure 4B:
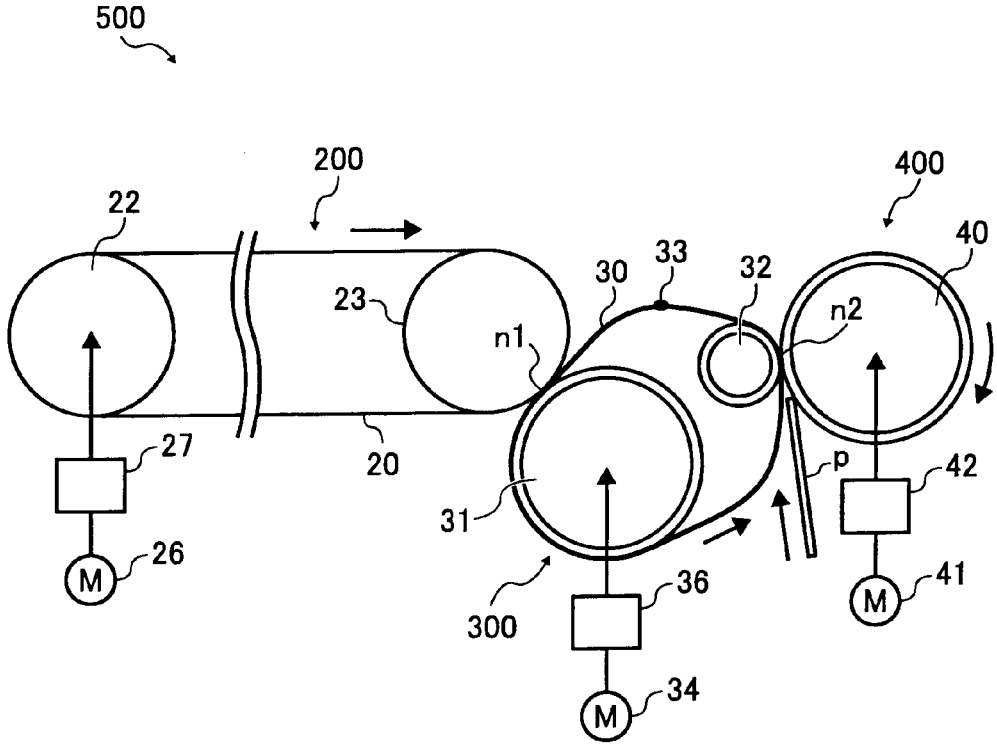

In addition, conversely, as shown in FIG. 4B, the second drive source 35 is dispensed with and a separate fourth drive source 41 for driving the pressure roller 40 of the secondary transfer device 400 is provided, the pressure roller 40 being rotationally driven by the fourth drive source 41 by way of a decelerator 42 with the drive force thereof being transmitted to the endless belt 30 by frictional contact therewith, that is to say, drive force is able to be transmitted from the exterior to move the endless belt 30 at the second transfer nip position n2 employing the fourth drive source 41 provided in the exterior of the endless belt 300.

Figure 4C:
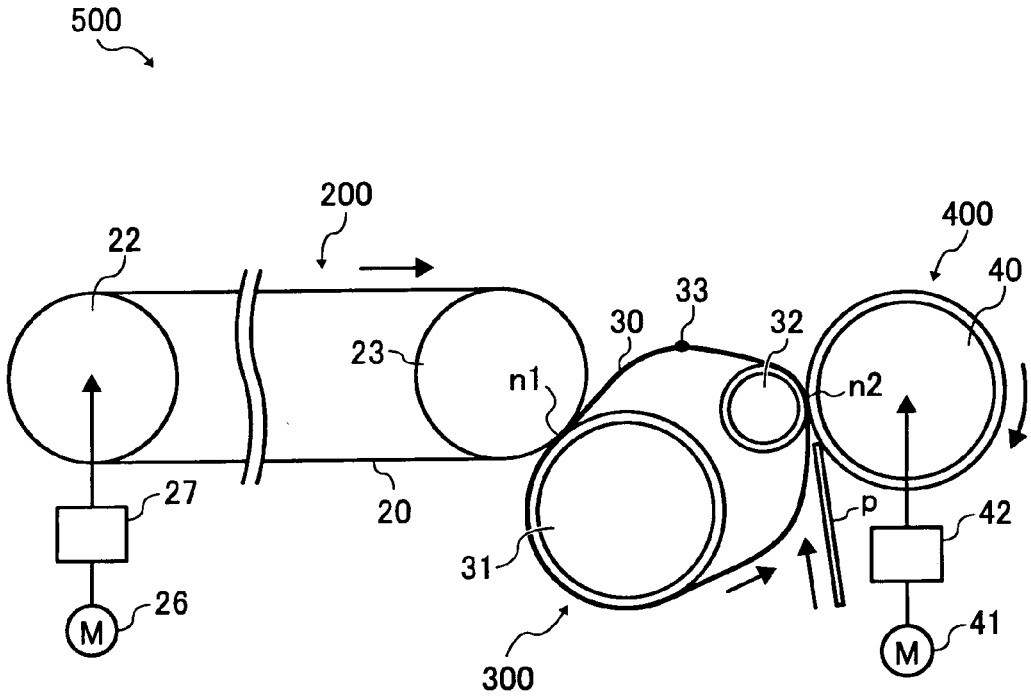

Furthermore, as shown in FIG. 4C, the two specialist drive sources 34, 35 of the endless belt 300 are dispensed with and drive force is able to be transmitted from the exterior to move the endless belt 30 at the first transfer nip position n1 employing the third drive source 26 provided in the exterior of the endless belt 300 and, in addition, drive force is able to be transmitted from the exterior to move the endless belt 30 at the second transfer nip position n2 employing the fourth drive source 41 provided in the exterior of the endless belt 300.

Figure 5:
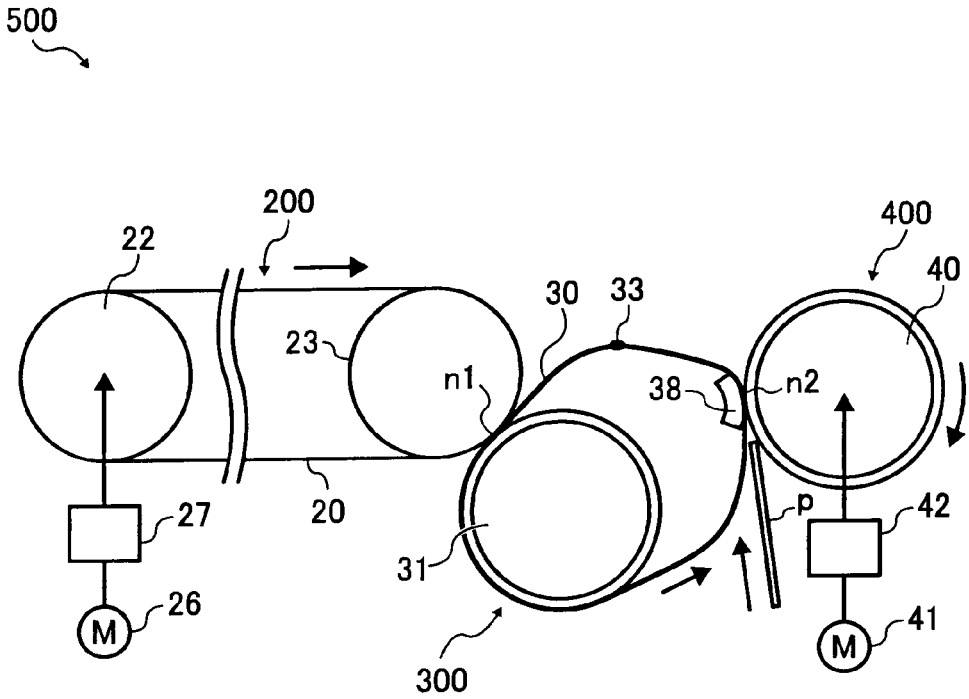
FIG. 5 is a diagram showing the configuration of a further modification of this image transfer device.

Here, as shown in FIG. 5, when specialist drive sources 34, 35 are not employed to rotationally drive the large roller 31 and small roller 32, a fixedly-provided non-rotating nip forming member 38 for forming the second transfer nip position n2 may be employed as a belt support member replacing the rotating roller.

Figure 6:
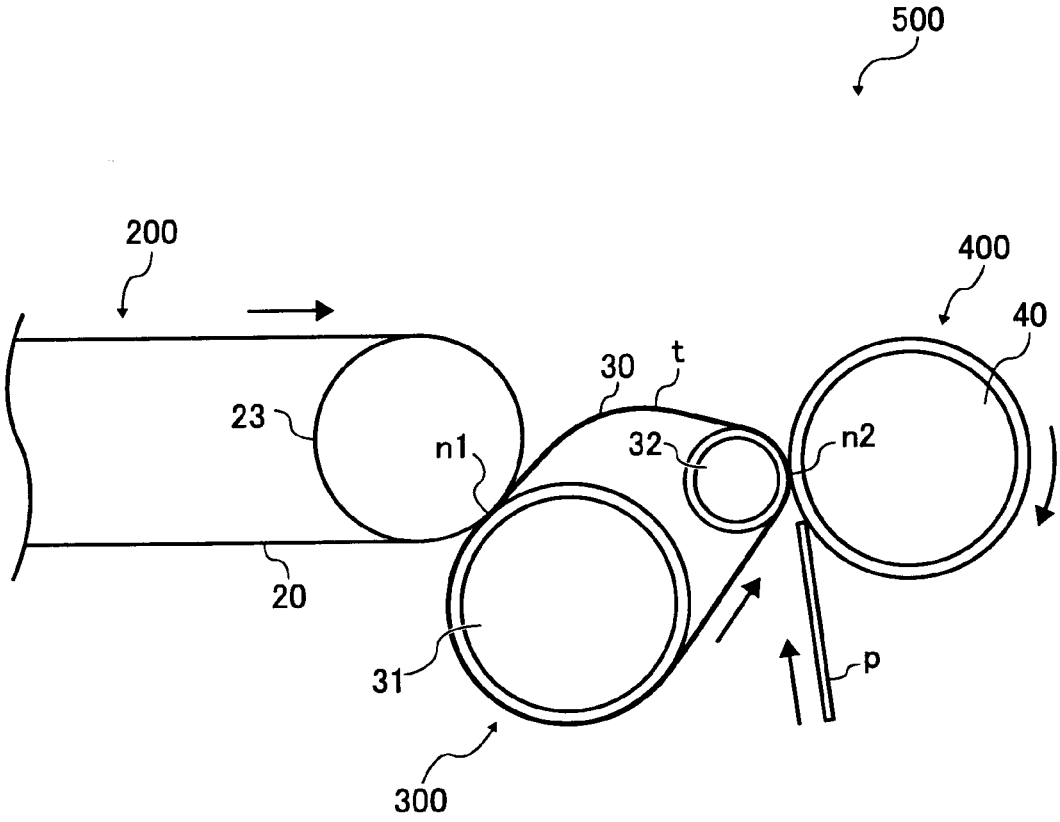
FIG. 6 is a diagram showing the configuration of another example of an image transfer device.

FIG. 6 shows another example of a configuration of the image transfer device 500.

In this example, the drive sources for moving the endless belt 30 are controlled so that the moving speed at which the endless belt 30 is moved at the second transfer nip position n2 is faster than the moving speed at which the endless belt 30 is moved at the first transfer nip position n1 and deflection is continuously generated in the endless belt 30 at the downstream position of the second transfer nip position n2.

Deflection is reliably generated in the endless belt 30 at the downstream position of the second transfer nip position n2 in this way and, as a result of the absorption of the torque fluctuation of the endless belt 30 by this deflection when, in particular, the recording material p goes into the second transfer nip position n2, the effect on the first transfer nip position n1 of change in moving speed of the endless belt 30 caused by this torque fluctuation can be effectively prevented.

In the image transfer device 500 of this example the effect on the first transfer nip position n1 of the torque fluctuation of the endless belt 30 when the recording material p comes out of the second transfer nip position n2 cannot be prevented. However, because the torque fluctuation of the endless belt 30 when the recording material p goes into the second transfer nip position n2 is greater than when the recording material p comes out of the second transfer nip position n2, the adoption of the configuration of this example is especially effective where the torque fluctuation of the former can be largely ignored by comparison to the latter.

Figure 7:
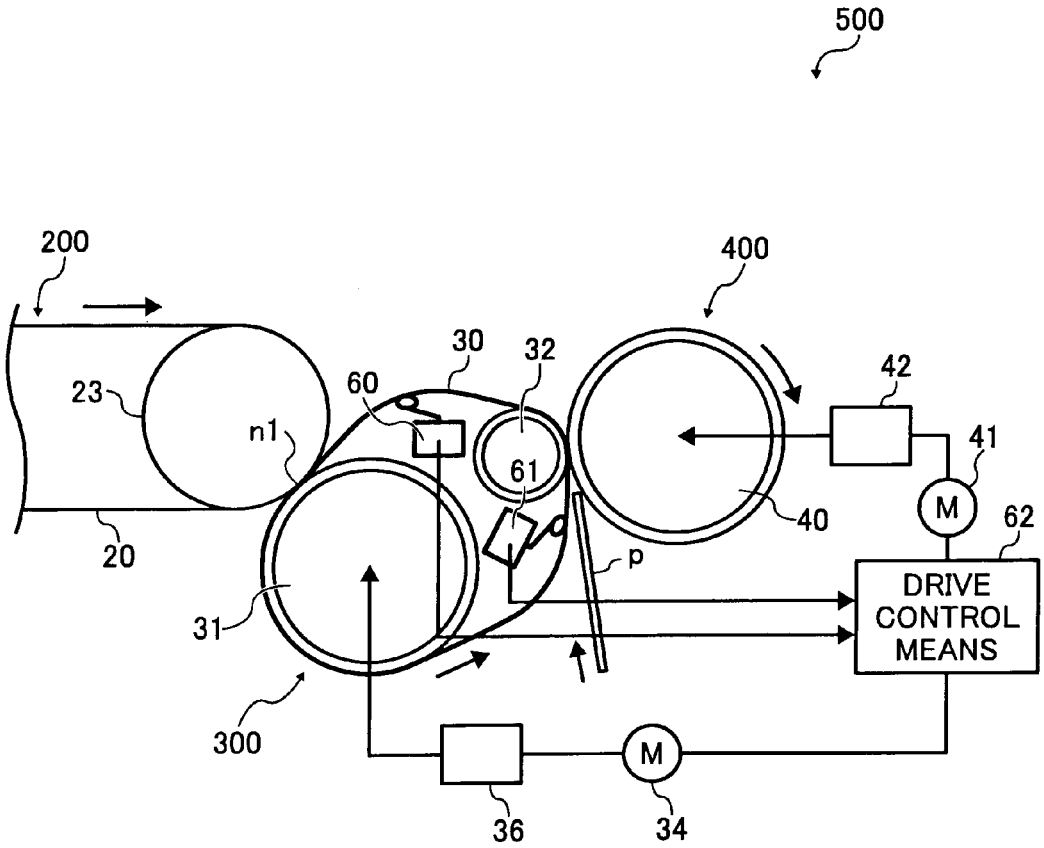
FIG. 7 is a diagram showing the configuration of another further example of an image transfer device.

FIG. 7 is a further example of a configuration of the image transfer device 500.

In addition to the image transfer device 500 of the configuration shown in FIG. 3, the image transfer device 500 of this example comprises a microswitch 60 in the downstream position of the second transfer nip position n2 and a microswitch 61 in the upstream position thereof provided as deflection amount detection means for detecting the deflection amount of the endless belt 30, and drive control means 62 for performing feedback control of, for example, the first drive source 34 and fourth drive source 41 serving as the drive sources in accordance with an output signal of these microswitches 60, 61.

The deflection amount of the endless belt 30 is detected by the microswitches 60, 61 and the output signal of the microswitches 60, 61 is input into drive control means 62, and the endless belt 30 is moved as a result of a feedback control performed by drive control means 62 on the first drive source 34 or fourth drive source 41 in accordance with the output signal thereof and rotation of the large roller 31 and pressure roller 40 by way of the decelerators 36, 42, the moving speed of the endless belt 30 at the first transfer nip position n1 being varied slightly from the moving speed of the endless belt 30 at the second transfer nip position n2 so as to generate a continuous fixed deflection in the endless belt 30 between the first transfer nip position n1 and the second transfer nip position n2.

As a result, the torque fluctuation generated in the endless belt 30 is absorbed by the deflection generated in the endless belt 30, and decrease in the deflection amount of the endless belt 30 as a result of absorption of the torque fluctuation is detected by the microswitches 60, 61 serving as deflection amount detections means. In addition, when the moving speed of the endless belt 30 is destabilized when the recording material p passes through the second transfer nip position n2 resulting in a disturbance of the deflection amount, this disturbance is detected by the microswitches 60, 61. The deflection amount is gradually restored to the original deflection amount by feedback control performed on the first drive source 34 or fourth drive source 41 by drive control means 62 so that when a subsequent torque fluctuation is generated it can be reliably absorbed, and so that when torque fluctuations are generated continuously in the endless belt 30 the effect of the torque fluctuation of the endless belt 30 generated at one transfer nip position on another transfer nip position can be constantly and effectively obstructed.

While in the example illustrated in the diagram the microswitches 60, 61 serving as deflection amount detections means are provided in the upstream position and downstream position of the second transfer nip position n2, there are no restrictions thereto and one or three or more microswitches may be provided.

The example described above describes an image transfer device 500 in which a toner image carried by a intermediate transfer device 200 serving as an image carrier devices is primary transferred onto an endless belt 30 of an endless belt 300 at the first transfer nip position n1, and the toner image carried on the endless belt 30 is secondary transferred onto the recording material p at the second transfer nip position n2.

Figure 8:
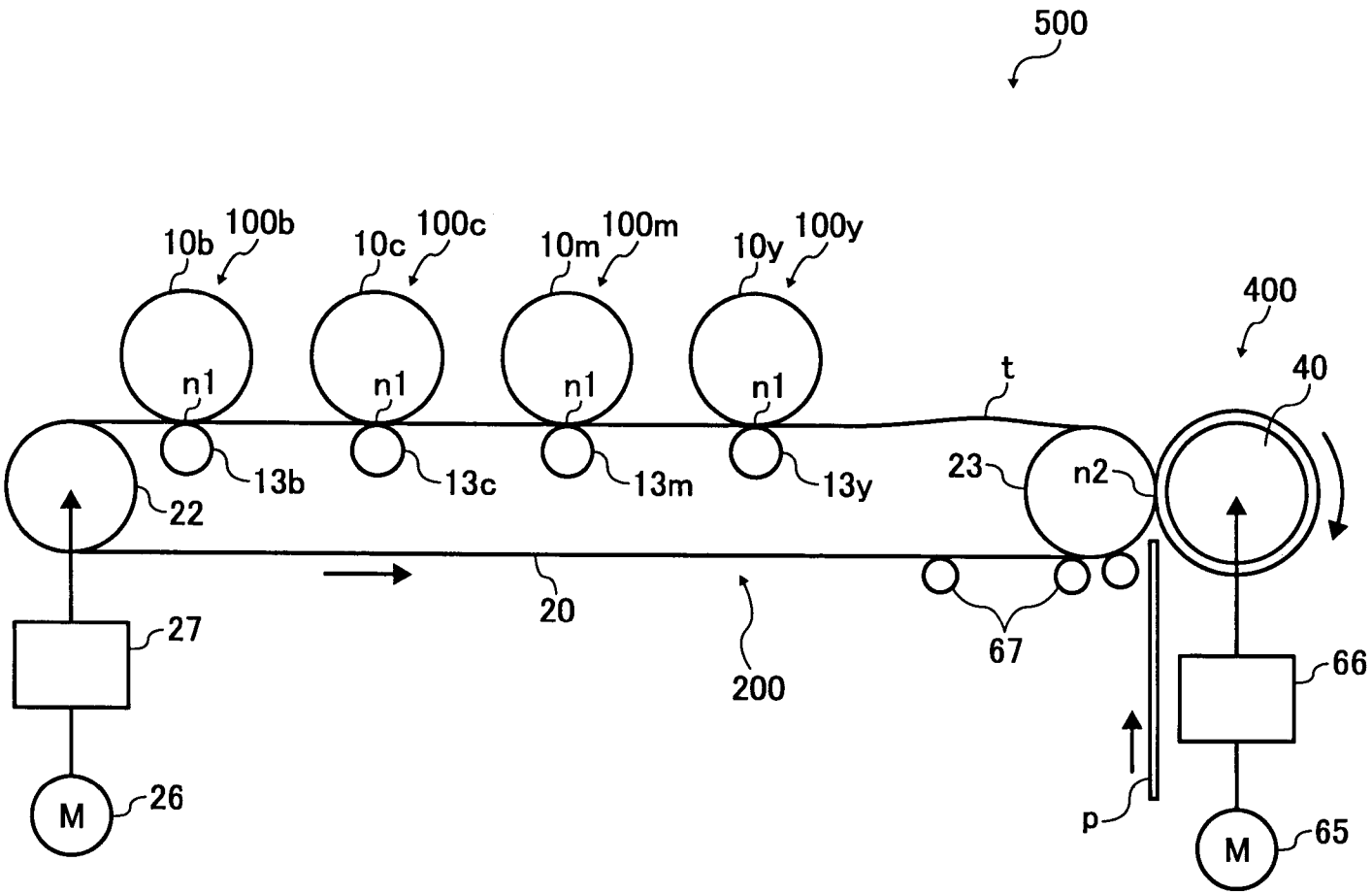
FIG. 8 is a diagram showing the configuration of another further example of an image transfer device.

FIG. 8 shows another example of a configuration of the image transfer device 500.

In this example of the image transfer device 500 toner images are formed by imaging devices 100*b*, 100*c*, 100*m*, 100*y* serving as image carrier devices, the toner images carried by respective photoconductive drums 10*b*, 10*c*, 10*m*, 10*y* are primary transferred onto the intermediate transfer member 20 of the intermediate transfer member 200 serving as the endless belt of the endless belt devices by transfer devices 13*b*, 13*c*, 13*m*, 13*y* at the first transfer nip position n1, and the toner images carried by the intermediate transfer member 20 are secondary transferred onto the recording material p by the pressure roller 40 of the secondary transfer device 400 at the second transfer nip position n2.

Next, to ensure the deflection t is continuously generated in the intermediate transfer member 20 between the first transfer nip position n1 and second transfer nip position n2, the intermediate transfer member 20 is turned by the drive roller 22 and driven roller 23 serving as belt support members, the third drive source 26 and fifth drive source 65 are driven to rotationally drive the drive roller 22 by way of the decelerator 27 and to rotationally drive the pressure roller 40 by way of the decelerator 66, and the intermediate transfer member 20 is driven at the first transfer nip position n1 and the second transfer nip position n2 individually to maintain the deflection t.

Accordingly, in particular in the image transfer device 500 of a type comprising imaging devices 100*b*, 100*c*, 100*m*, 100*y* for forming images on the photoconductive drums 10*b*, 10*c*, 10*m*, 10*y* serving as image carrier devices, the torque fluctuation of the intermediate transfer member 20 generated when the seam of the intermediate transfer member 20 serving as the endless belt passes through one of the transfer nip positions and when the recording material goes into the second transfer nip position n2 and comes out of the second transfer nip position n2 and so on are absorbed by the deflection t generated in the intermediate transfer member 20, and change in the moving speed of the intermediate transfer member 20 due to torque fluctuation and the effect thereof on the other transfer nip position can be effectively prevented.

The symbol 67 in the diagram schematically denotes toner affixed to the intermediate transfer member 20 from which the toner image carried on the intermediate transfer member 20 is formed.

In the image transfer device 500 as shown in FIG. 8, because the deflection amount of the intermediate transfer member 20 decreases each time the recording material p passes though the second transfer nip position n2, the fifth drive source 65 is driven to rotate the pressure roller 40 of the secondary transfer device 400 and restore and maintain the deflection amount at the original amount when the recording material p is not passing through the second transfer nip position n2. The intermediate transfer member 20 can be reliably moved without slip to restore the deflection amount to the original amount while the recording material p is not at the second transfer nip position n2.

Figure 9:
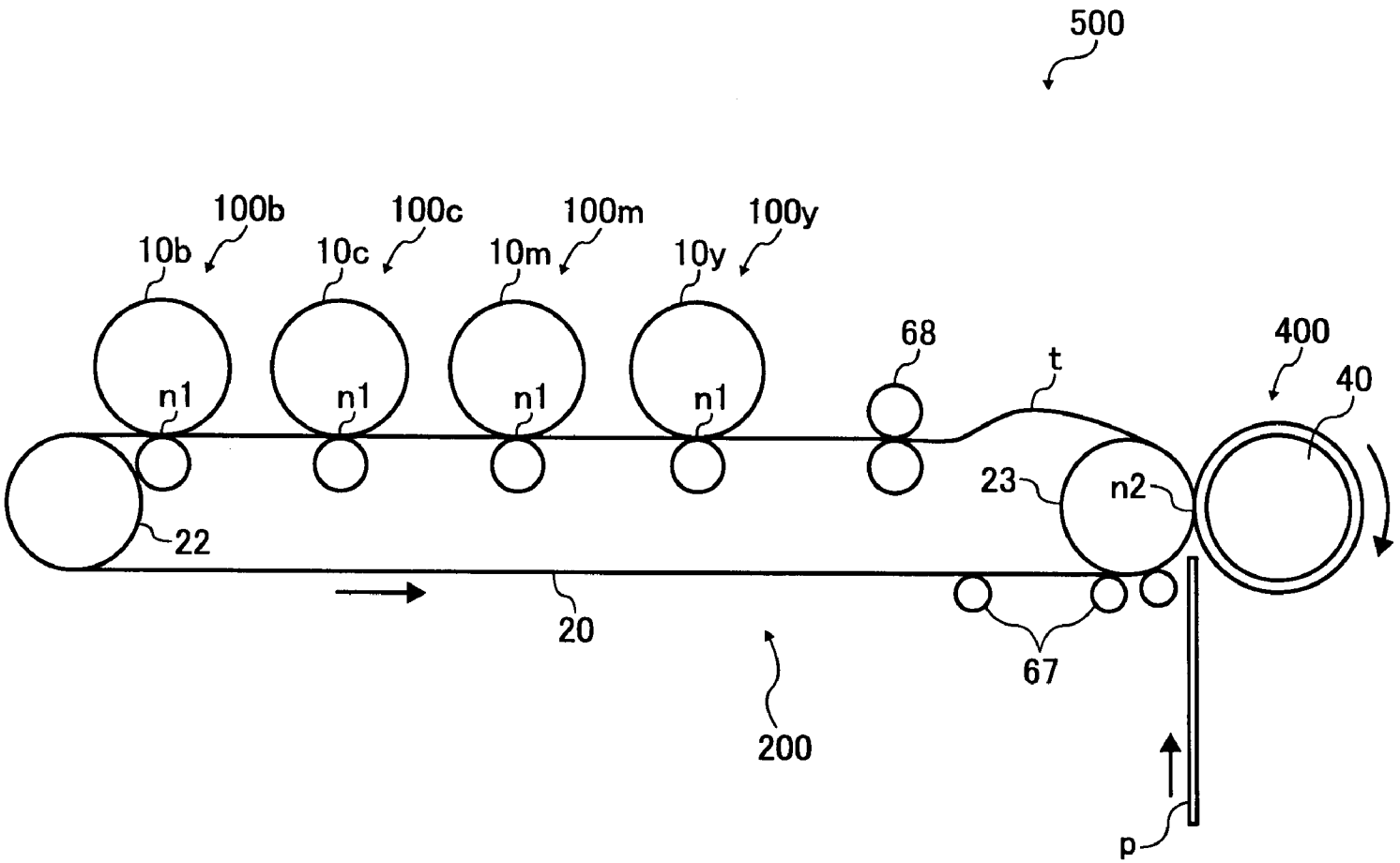
FIG. 9 is a diagram showing the configuration of a first modification of the image transfer device shown in FIG. 8.

FIG. 9 shows one modification of the image transfer device 500 shown in FIG. 8.

In this example, a pair of rollers 68 are provided between the second transfer nip position n2 and the first transfer nip position n1 of the photoconductive drum 10*y* of the image transfer device 500 of the configuration shown in FIG. 8 sandwiching the intermediate transfer member 20 and restricting the range across which the deflection t is formed.

Figure 10:
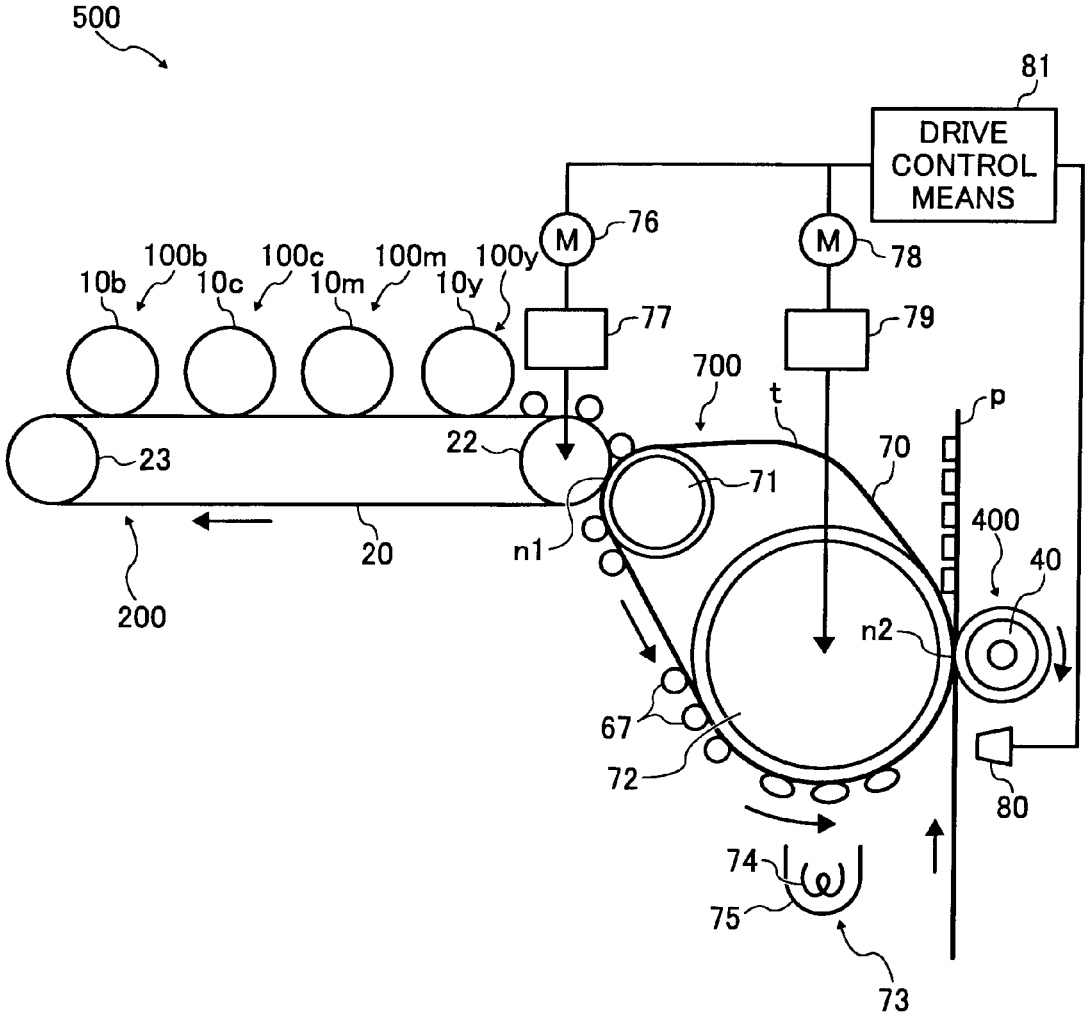
FIG. 10 is a diagram showing the configuration of another further example of an image transfer device.

FIG. 10 shows another modification of the image transfer device 500.

In the image transfer device 500 of this example, toner images carried by each of the photoconductive drums 10*b*, 10*c*, 10*m*, 10*y* as a result of formation thereon by the imaging devices 100*b*, 100*c*, 100*m*, 100*y* are transferred onto the intermediate transfer member 20 of the intermediate transfer device 200 serving as the image carry device, the toner images carried by the intermediate transfer member 20 are primary transferred at the first transfer nip position n1 onto a transfer fixing belt 70 of a transfer fixing device 700 serving as the endless belt of an endless belt device, and the toner images carried on the transfer fixing belt 70 are secondary transferred at the second transfer nip position n2 onto the recording material p by the pressure roller 40 of the secondary transfer device 400.

In this transfer fixing device 700 the transfer fixing belt 70 is turned with a deflection t between a small roller 71 and a large roller 72 and, while on the one hand the small roller 71 is pushed against the drive roller 22 of the intermediate transfer device 200 by way of the transfer fixing belt 70 and intermediate transfer member 20, the large roller 72 is pushed against the pressure roller 40 of the secondary transfer device 400 by way of the transfer fixing belt 70.

In addition, heating means 73 for heating the toner image carried by the transfer fixing belt 70 is provided around the transfer fixing device 700 serving as the endless belt device, the toner 67 being heated by heating means 73 and the heated toner image being transferred and simultaneously fixed to the recording material p by the pressure roller 40 of the secondary transfer device 400. Heating means 73 is configured from, for example, a halogen heater 74 for heating the toner image and a reflecting plate 75 for reflecting the heat of the halogen heater 74 toward the transfer fixing belt 70.

In addition, in this example, the drive force of a sixth drive source 76 is transferred to the drive roller 22 by way of a decelerator 77 to move the intermediate transfer member 20 turned between the driven roller 23 in the direction shown by the arrow and, in addition, while on the one hand the transfer fixing belt 70 is moved at the first transfer nip position n1 as a result of frictional contact with the intermediate transfer member 20, the drive force of a seventh drive source 78 is transmitted to the large roller 72 by way of a decelerator 79 to move the transfer fixing belt 70 at the second transfer nip position n2 in the direction shown by the arrow, and the pressure roller 40 is driven and rotated in the direction shown by the arrow at the second transfer nip position n2 as a result of frictional contact with the transfer fixing belt 70. In addition, at normal operation the moving speed at which the transfer fixing belt 70 moves at the second transfer nip position n2 is made faster than the moving speed at which the transfer fixing belt 70 moves at the first transfer nip position n1 to generate deflection t at the downstream position of the second transfer nip position n2.

Recording material detection means 80 such as a photosensor for detecting the recording material p passing through the second transfer nip position n2 is provided in the upstream position of the second transfer nip position n2 in the direction in which the recording material p is carried. Drive control means 81 into which the output signal of recording material detection means 80 is input and which, in accordance with the output signal thereof, performs a feedback control of the sixth drive source 76 and seventh drive source 78 is also provided. More specifically, when the recording material p is detected by recording material detection means 80, the moving speed at which the transfer fixing belt 70 is moved at the second transfer nip position n2 is made equal with the moving speed at which the transfer fixing belt 70 moves at the first transfer nip position n1, or the latter is made slower than the former, by drive control means 81.

Accordingly, deflection is generated in the transfer fixing belt 70 at the downstream position of the second transfer nip position n2 prior to the recording material p advancing into the second transfer nip position n2 whereupon the torque fluctuation of the transfer fixing belt 70 when the recording material p goes into the second transfer nip position n2 is absorbed. On the other hand, when the recording material p passing through the second transfer nip position n2 is detected, a feedback control of the sixth drive source 76 and drive source 78 is performed to generate deflection in the transfer fixing belt 70 at the upstream position of the second transfer nip position n2 whereupon the torque fluctuation of the transfer fixing belt 70 when the recording material p comes out of the second transfer nip position n2 is absorbed and change in the moving speed of the transfer fixing belt 70 due to the torque fluctuation and the effect of this change on the first transfer nip position n1 can be effectively prevented.

That is to say, when the recording material p goes into the second transfer nip position n2, the moving speed of the transfer fixing belt 70 is slowed to generate a speed fluctuation. Because of the deflection of the transfer fixing belt 70 at the downstream position of the second transfer nip position n2 at this time, the slowing of the moving speed of the transfer fixing belt 70 has no effect at all on the moving speed of the transfer fixing belt 70 at the first transfer nip position n1 due to a change in the deflection amount.

In addition, deflection is generated in the transfer fixing belt 70 at the upstream position of the second transfer nip position n2 by slowing the moving speed of the transfer fixing belt 70 at timings prior to and subsequent to the recording material p advancing into the second transfer nip position n2. While in this state the moving speed of the recording material p increases and a speed fluctuation is generated when the rear end of the recording material p comes out of the second transfer nip position n2, because of the deflection of the transfer fixing belt 70 at the upstream position of the second transfer nip position n2, the increase of the moving speed of the transfer fixing belt 70 has no effect at all on the moving speed of the transfer fixing belt 70 at the first transfer nip position n1 due to a change in the deflection amount.

In addition, while the example above describes a case in which images carried by all image carrier devices are primary transferred onto the endless belt of the endless belt device at the first transfer nip position n1 and the images carried on the endless belt are secondary transferred onto the recording material p at the second transfer nip position n2, the images carried on the endless belt may be secondary transferred onto a transfer image carrier device for carrying transfer images rather than onto a recording material.

Figure 11:
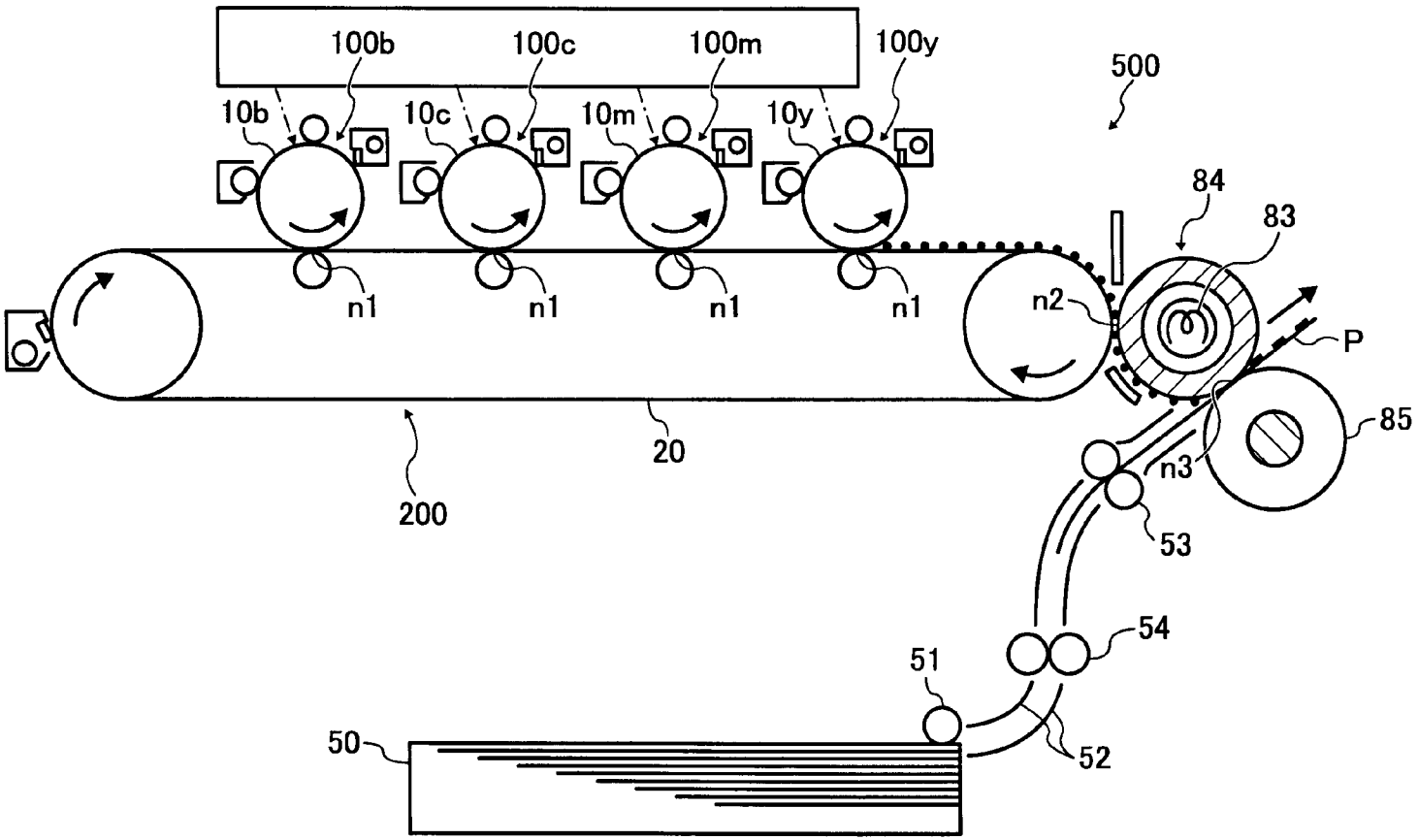
FIG. 11 is a diagram showing the configuration of another further example of an image transfer device.

FIG. 11 shows another example of the configuration of the image transfer device 500.

In this image transfer device 500 toner images on the photoconductive drums 10*b*, 10*c*, 10*m*, 10*y* of the imaging devices 100*b*, 100*c*, 100*m*, 100*y* are primary transferred onto the intermediate transfer member 20 of the intermediate transfer device 200, the toner images carried by the intermediate transfer member 20 are secondary transferred onto a transfer fixing roller 84 in which a heater 83 is housed, and the toner images carried by the transfer fixing roller 84 are transferred onto the recording material p and simultaneously fixed by a transfer roller 85.

The recording material p is paid out from the recording material tray 50 by the supply roller 51 and, while being guided by the guide member 52, is carried by the carry roller 54 and fed out to a third transfer nip position n3 by the resist roller 53 at a predetermined timing.

In addition, the moving speed of the intermediate transfer member 20 serving as the endless belt at the first transfer nip position n1 and the moving speed of the intermediate transfer member 20 at the second transfer nip position n2 where the intermediate transfer member 20 is secondary transferred onto the transfer fixing roller 84 serving as the image carrier devices are set as appropriate to generate deflection continuously in the intermediate transfer member 20 between the first transfer nip position n1 and the second transfer nip position n2.

In the image transfer device 500 of a type that performs secondary transfer onto the transfer fixing roller 84 serving as the transfer image carrier device at the second transfer nip position n2 in particular in this way, the torque fluctuation of the intermediate transfer member 20 generated when the seam of the intermediate transfer member 20 serving as the endless belt passes through the transfer nip position and so on are absorbed by the deflection generated in the intermediate transfer member 20 whereupon change in the moving speed of the intermediate transfer member 20 due to torque fluctuations and the effect of this change on the other transfer nip position can be effectively prevented.

Figure 12:
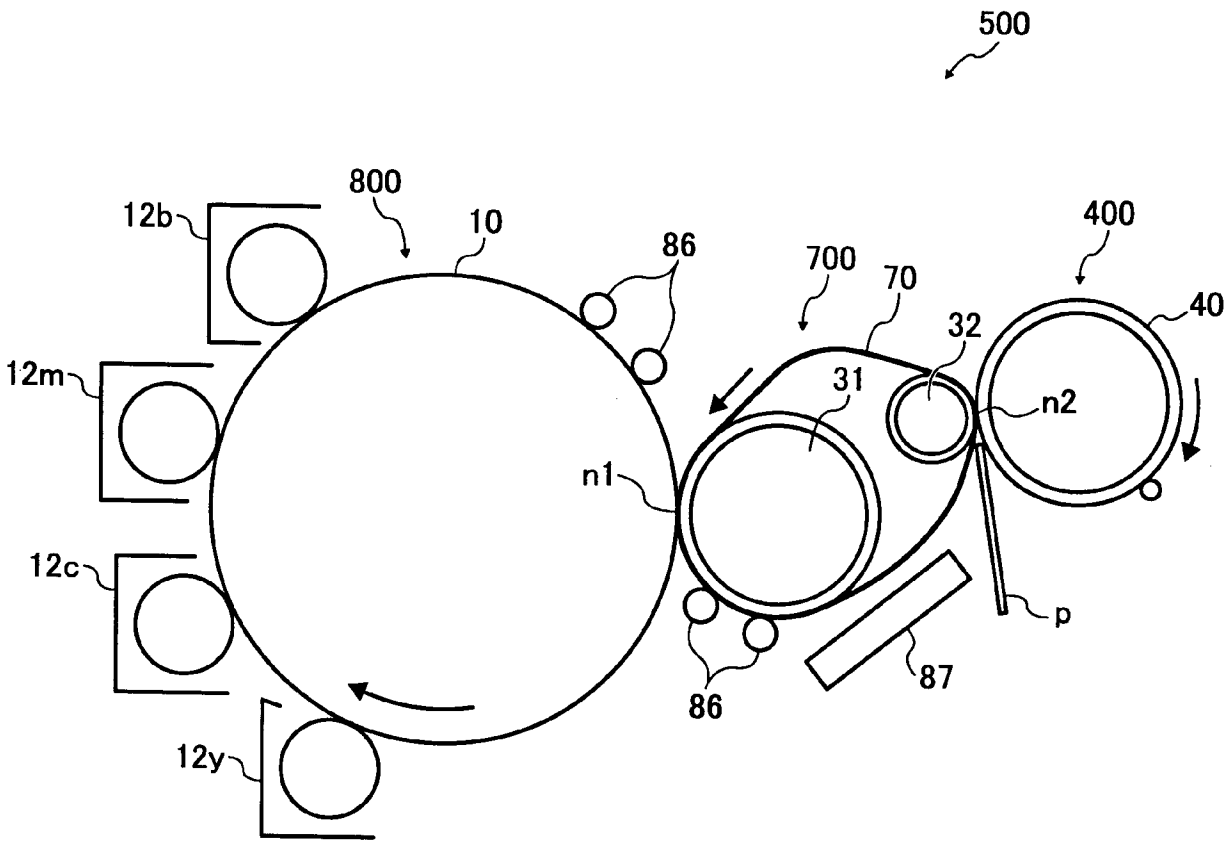
FIG. 12 is a diagram showing the configuration of another further example of an image transfer device.

FIG. 12 shows another example of the configuration of the image transfer device 500.

In this image transfer device 500, a toner image on a photoconductive drum 10 of a color imaging device 800 is primary transferred onto the transfer fixing belt 70 of the transfer fixing device 700 at the first transfer nip position n1, and the toner image carried by the transfer fixing belt 70 is secondary transferred at the second transfer nip position n2 onto the recording material p by the pressure roller 40 of the secondary transfer device 400 and simultaneously fixed.

While a belt may be employed as the color imaging device 800 serving as the image carrying device, in the example shown in this diagram, four developer devices 12*y*, 12*c*, 12*m*, 12*b* of yellow, cyan, magenta and black are provided around a photoconductive drum 10. In addition, when a full color image is recorded on the recording material p, accompanying rotation of the photoconductive drum 10 in the direction shown by the arrow in the diagram, first, a first color electrostatic latent image is formed on the photoconductive drum 10 by charging thereof by a charging device not shown in the diagram and writing by means of an exposure device whereupon, following development thereof by a first color developer device, a first color toner image is formed on the photoconductive drum 10.

Next, following this first transfer, a second color electrostatic image is formed on the photoconductive drum 10 by a similar charging thereof by a charging device not shown in the diagram and writing by means of an exposure device whereupon, following development by a second color developer device, a second color toner image is overlappingly formed on the first color toner image on the photoconductive drum 10. A full color image is formed on the photoconductive drum 10 by forming third color and fourth color toner images in the same way. The symbol 86 in the diagram shows schematically the toner used to form the full color image.

In the transfer fixing device 700 serving as the endless belt device, the transfer fixing belt 70 comprising an induction exothermic layer is turned between the large roller 31 and small roller 32 serving as belt support members, and an induction heating device 87 comprising an induction coil is provided therearound. In addition, the induction exothermic layer of the transfer fixing belt 70 rotating in the direction shown by the arrow in the diagram is caused to emit heat by the induction coil of the induction heating device 87 whereupon the full color image primary transferred onto the transfer fixing belt 70 of the transfer fixing device 700 is heated at the first transfer nip position n1.

While not shown in the diagram, the recording material p is similarly paid out by the supply roller from the recording material tray and delivered to the second transfer nip position n2 by a resistant roller at a predetermined timing. The heated full color image is secondary transferred and pressured by the pressure roller 40 of the secondary transfer device 400 at the second transfer nip position n2 onto the recording material p, and is simultaneously fixed as it is transferred.

In this image transfer device 500 as well, the moving speed of the transfer fixing belt 70 serving as the endless belt at the first transfer nip position n1 and the moving speed of the transfer fixing belt 70 at the second transfer nip position n2 are set as appropriate to generate deflection continuously in the intermediate transfer member 20 between the first transfer nip position n1 and the second transfer nip position n2.

In an image transfer device 500 of a type in which the image carried on the photoconductive drum 10 of, in particular, the color imaging device 800 serving as the image carrier device is primary transferred at the first transfer nip position n1 onto the transfer fixing belt 70 of the transfer fixing device 700 serving as the endless belt of the endless belt device and the image carried on the transfer fixing belt 70 is secondary transferred onto the recording material p at the second transfer nip position n2 in this way, the torque fluctuation of the transfer fixing belt 70 generated when the seam of the transfer fixing belt 70 passes through the transfer nip position are absorbed by the deflection generated by the transfer fixing belt 70 whereupon change in the moving speed of the transfer fixing belt 70 due to this torque fluctuation and the effect of this change on the other transfer nip position can be effectively prevented.

The following effects are afforded by the first embodiment described above.

(1) Because the effect of a torque fluctuation generated at one transfer nip position on the other transfer nip position is prevented by simply turning of an endless belt between belt support members with deflection between a primary transfer nip position and secondary transfer nip position and setting of the moving speed at the primary transfer nip position and the moving speed at the secondary transfer nip position as appropriate, the need to increase output of the drive source of the image transfer device and to improve the drive transmission rigidity of the decelerator relaying the drive force of the drive sources is eliminated and, in turn, concerns regarding the size and width and so on of the apparatus and the associated increased costs can be eliminated.

(2) The torque fluctuation of the endless belt generated when the seam of the endless belt passes through the transfer nip position and when the recording material goes into the secondary transfer nip position and comes out of the secondary transfer nip position are absorbed by deflection generated in the endless belt whereupon change in the moving speed of the endless belt due to this torque fluctuation and the effect of this change on the other transfer position can be effectively prevented and, in turn, the generation of image warp such as so-called shock jitter can be eliminated.

Second Embodiment

The description of this embodiment is based on a description of the prior art pertaining to this embodiment as given hereinafter with reference to the drawings.

Figure 13:
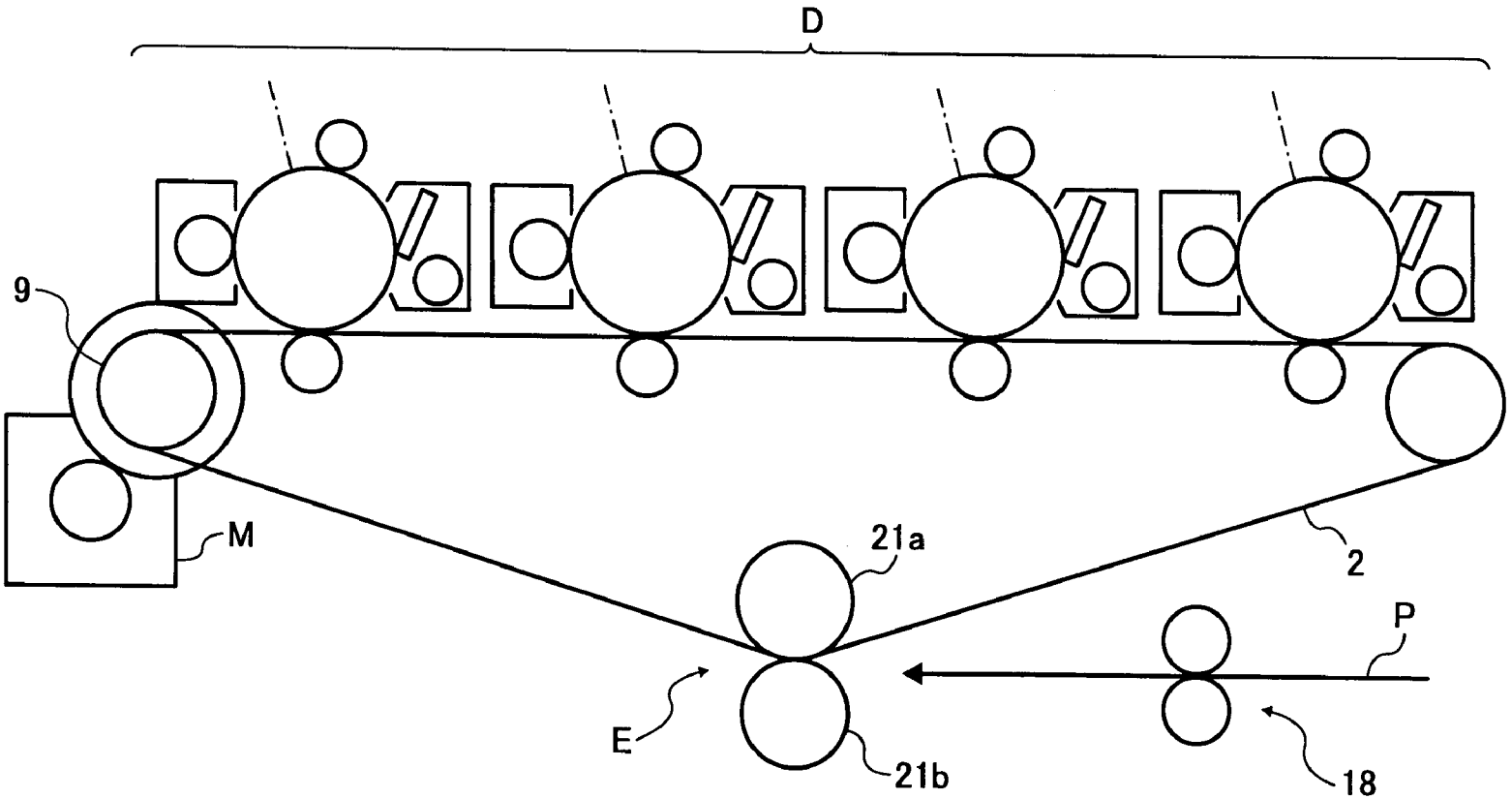
FIG. 13 PRIOR ART
FIG. 13 is a diagram for explaining image transfer onto extra thick paper in an image transfer device of an image forming apparatus comprising photoconductive drums arranged in a tandem configuration.

FIG. 13 shows a configuration of a primary transfer portion and secondary transfer portion of a conventional color image forming apparatus. The symbol D in the diagram denotes the primary transfer portion and the symbol E denotes the secondary transfer portion. Furthermore, the symbol 2 denotes an endless belt serving as an intermediate transfer member, 9 denotes a drive roller, 18 denotes a resist roller, 21*a* denotes a secondary transfer roller, 21*b* denotes an opposing roller, P denotes a recording material, M denotes a DC motor or pulse motor serving as a drive source, and b denotes a nip portion formed between the secondary transfer roller 21*a* and opposing roller 21*b*.

In a color image forming apparatus such as this, when the recording material P being carried in the direction shown by the arrow in the diagram is an extra thick paper, load fluctuation generated when the front end portion thereof goes into the nip portion b or the rear end portion comes out of the nip portion b is transferred from the secondary transfer portion E to the drive roller 9 by way of the endless belt 2 serving as the intermediate transfer member. A drive shaft of the drive roller 9 is coupled to the drive motor M by way of a rotating joint mechanism or decelerator mechanism. The intermediate transfer belt 2 winds around the drive roller 9, minute movement amounts thereof being controlled by friction drive force. When load fluctuation at the secondary transfer portion E cannot be controlled by the drive roller 9 small movement speed errors of the intermediate transfer belt 2 are transferred to the primary transfer portion D upstream thereof which result in the generation of fluctuation, that is to say, shock jitter, in the transfer position which in turn causes defects in the transferred image.

Figure 14A:
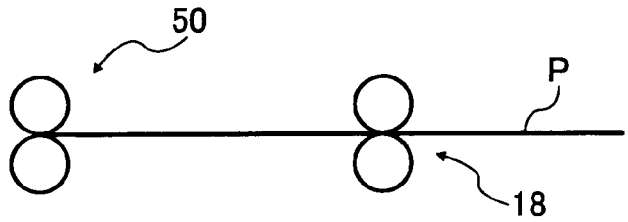
FIGS. 14A and 14B are diagrams for explaining measurement of speed fluctuation of the extra thick paper in this image transfer onto extra thick paper.
Figure 14B:
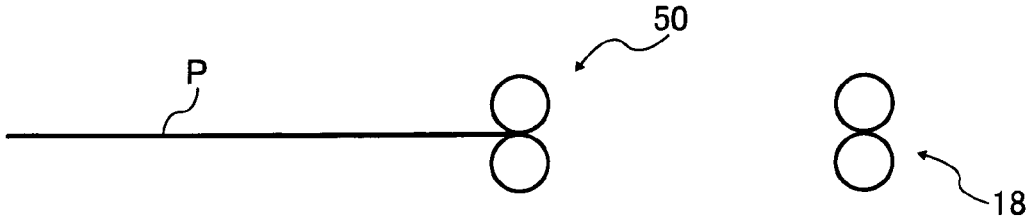

Measurement of the speed fluctuation of the intermediate transfer belt 2 will be described in detail hereinafter with reference to FIGS. 14A and 14B. FIG. 14A shows the state of the front end portion of the blank paper P going into a measurement roller 50, and FIG. 14B shows a state of the rear end portion coming out therefrom. The actual measurement results of speed fluctuation in the measurement roller 50 of a blank paper P carried by two pairs of rollers indicate that the generation of speed fluctuation is largest when the front end portion of the blank paper P goes into the measurement roller 50 and when the rear end portion comes out therefrom.

Figure 15:
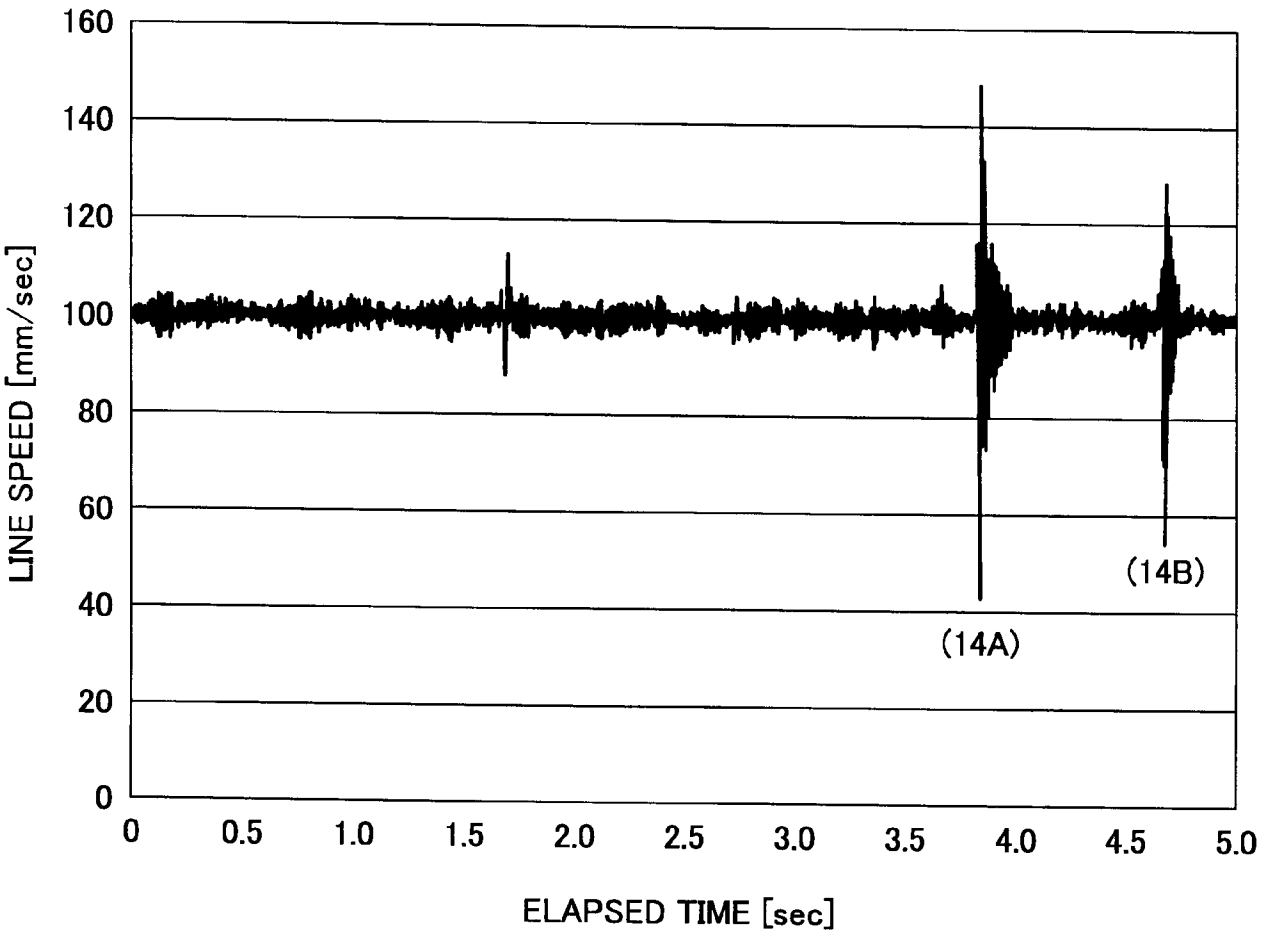
FIG. 15 is a diagram for explaining the measurement results of speed fluctuation.

FIG. 15 shows one example of the measurement results of this load fluctuation. The symbols (14A) and (14B) in the diagram denote the speed fluctuation in the state shown in FIGS. 14A and 14B. It is clear from the diagram that speed fluctuation increases significantly when the recording medium P is an extra thick paper.

The second embodiment for resolving the problems of the prior art described above will be hereinafter described in detail with reference to the diagrams.

Figure 16:
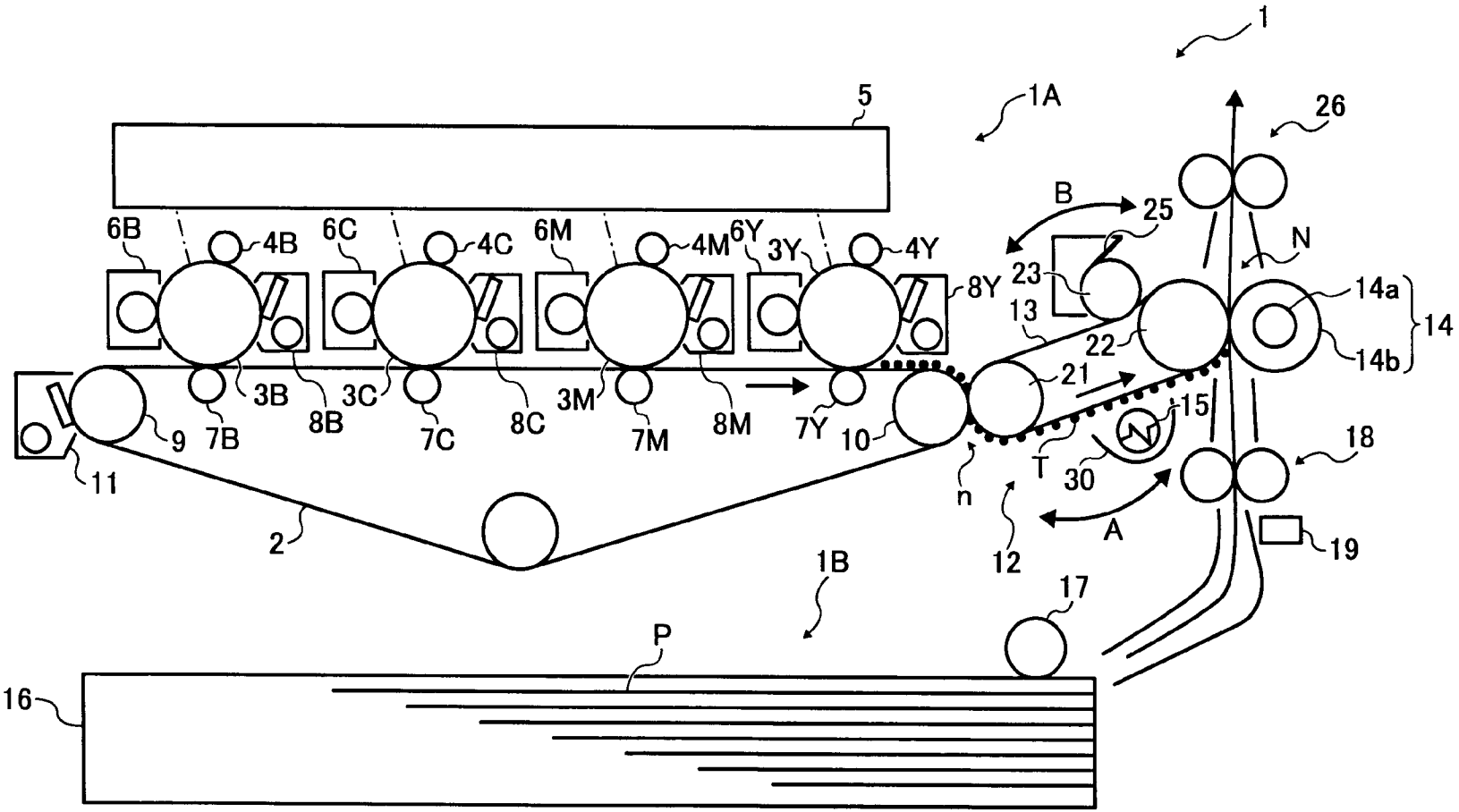
FIG. 16 is a diagram showing a configuration of a tandem-type color copier as an image forming apparatus pertaining to a second embodiment of the present invention.

FIG. 16 shows a configuration of a tandem-type electrophotographic-type color copier as a color image forming apparatus pertaining to this embodiment.

The symbol 1 in the drawing denotes a color copier, 2 denotes an intermediate transfer belt, 3 denotes photoconductive drums, 4 denotes charging devices, 5 denotes a writing device, 6 denotes developer devices, 7 denotes primary transfer devices, 8 denotes cleaning devices, 9 denotes a drive roller, 10 denotes a driven roller (serving as a secondary transfer roller), 11 denotes a cleaning device, 12 denotes a fixing device, 13 denotes a transfer fixing device, 14 denotes a pressure roller, 15 denotes a halogen heater, 16 denotes a paper supply tray, 17 denotes a paper supply roller, 18 denotes a register roller pair, 19 denotes a register sensor, 21 denotes a secondary transfer roller, 22 denotes a transfer fixing roller, 23 denotes a cleaning roller, 25 denotes a scraper, 26 denotes a discharge roller pair, 27 denotes a pressure roller, 30 denotes a reflecting plate, 1A denotes an image forming portion, 11 denotes a paper supply portion, A denotes an upstream region from a nip portion, B denotes a downstream region of the nip portion, n denotes a secondary transfer nip portion, N denotes a fixing nip portion, and P denotes a recording medium P.

The configuration and actuation of this color copier will be described in detail hereinafter.

The color copier 1 comprises the image forming portion 1A located in the middle portion of the apparatus main body, the paper supply portion 1B located below the image forming portion 1A, and an image read portion not shown in the diagram located above the image forming portion 1A. A configuration in which the intermediate transfer belt 2 serving as the intermediate transfer member is arranged with its transfer surface extending in the horizontal direction is provided in the image forming portion 1A, an image of a color-separated colors and complementary colors being formed on the upper surface of the intermediate transfer belt 2. That is to say, photoconductive drums 3Y, 3M, 3C, 3B serving as image carriers able to carry images of complementary color toners (yellow, magenta, cyan, black) are juxtaposedly arranged along the transfer surface of the intermediate transfer belt 2. The photoconductive drums 3Y, 3M, 3C, 3B are configured from drums rotatable in the same direction (anticlockwise direction) around which are arranged charging devices 4, writing device 5 as the optical write means, developer devices 6, primary transfer devices 7 and cleaning devices 8 for executing image forming processing as the rotation is performed.

The alphabetical letters assigned to each symbol denote, as in the case of the photoconductive drum 3, the different toner colors. The respective color toners are housed in the developer devices 6. The intermediate transfer belt 2 comprises a configuration that is turned between the drive roller 9 and the driven roller 10, and which is movable in the same direction therewith in an opposing position to the photoconductive drums 3Y, 3M, 3C, 3B. The cleaning device 11 for cleaning the surface of the intermediate transfer belt 2 is provided in a position opposing the drive roller 9.

The surface of the photoconductive drum 3Y is uniformly charged by the charging device 4 and, in accordance with image information from an image read portion, an electrostatic latent image is formed on the photoconductive drum 3Y. The electrostatic latent image is visualized as a toner image by the developer device 6Y in which a yellow toner is housed, and the toner image is primary transferred onto the intermediate transfer belt 2 by the primary transfer device 7Y to which a predetermined bias is imparted. Image formation is similarly performed with the different toner colors of the other photoconductive drums 3M, 3C, 3B to transfer and overlap toner images of each color in sequence on the intermediate transfer belt 2. The toner remaining on the photoconductive drum 3 following transfer is removed by the cleaning device 8 and, in addition, the electric potential of the photoconductive drum 3 is restored to its original state following transfer in preparation for the next imaging step by a decharging lamp not shown in the diagram.

The fixing device 12 is provided in a position opposing the driven roller 10. The fixing device 12 comprises a transfer fixing belt 13 serving as a transfer fixing member to which a non-fixed toner image as the image on the intermediate transfer belt 2 is transferred, the secondary transfer roller pairs 10, 21 for forming the secondary transfer nip portion n with the intermediate transfer belt 2, the transfer fixing roller 22 for rotationally driving the transfer fixing belt 13, and the pressure roller 14 serving as a pressure member or opposing member for forming the fixing nip portion N with the transfer fixing belt 13. The transfer fixing belt 13 comprises an elastic layer of silicon rubber or the like on an approximately 100 μm base material of polyimide or the like, a release layer of a PFA coating or the like being coated thereon as the upper layer. In addition, the halogen heater 15 as heating means for heating the image on the transfer fixing belt 13 and reflecting plate 30 are provided in proximity of the transfer fixing belt 13 in the exterior or inner part thereof. The pressure roller 14 comprises a core metal 14*a* and an elastic layer 14*b* of rubber or the like.

The paper supply part 1B comprises the paper supply tray 16 in which the recording medium P (hereinafter referred to simply as blank paper P) is housed in a ream, the paper supply roller 17 for separating and supplying the blank paper P of the paper supply tray 16 in single sheets in order from the top, and the resist roller 18 which, following temporary stoppage of the supplied blank paper P and correction of diagonal displacement, feeds the blank paper out toward the fixing nip portion N at a timing at which the front end of the image on the transfer fixing belt 13 coincides with a predetermined position in the direction of carry. The timing at which the blank paper is fed out is established in accordance with the register sensor 19 provided in the upstream side of the resist roller pair. A discharge roller for pinching the blank paper and feeding it out in the direction of discharge from the main body is provided in the downstream side of the fixing nip portion N.

The toner image T (hereinafter referred to simply as toner) primary transferred onto the intermediate transfer belt 2 from the photoconductive drums 3Y, 3M, 3C, 3B is secondary transferred by means of an electrostatic force onto the transfer fixing belt 13 by a bias (containing overlaid AC, pulse and so on) imparted to the secondary transfer roller (driven roller) 10 by bias imparting means not shown in the diagram. In order to improve the secondary transfer characteristics, that is to say, the close adhesion between the intermediate transfer belt and the transfer fixing belt 13, the secondary transfer roller 10 is pressured in the center direction of the transfer fixing belt 13 by a spring by way of a bearing provided in both ends thereof not shown in the diagram.

The toner image T transferred from the intermediate transfer belt 2 to the transfer fixing belt 13 is independently heated on the transfer fixing belt 13 until it is fixed on the blank paper P at the fixing nip portion N. Because the process for heating the toner T alone is able to be achieved satisfactorily in advance, the heating temperature can be kept comparatively lower than in conventional methods in which the toner T and blank paper P are simultaneously heated. It was confirmed through actual testing that satisfactory image quality could be produced even at low temperatures of the transfer fixing belt 13 of 110 to 120° C. With consideration of the drop in temperature produced by the blank paper, a heat amount of the order of 1.5 times that used for monochrome image forming apparatuses is adopted in conventional color image forming apparatuses to produce satisfactory gloss. Accordingly, the blank paper is heated to a temperature above what is required and the close adhesion of the toner and blank paper is increased above what is required.

Because the temperature for producing satisfactory gloss can be independently set in this embodiment without need for consideration of the blank paper P, the temperature of the transfer fixing belt 13 (fixing set temperature) can be reduced. In addition, because the blank paper P is heated at the secondary nip portion N only, overheating and increase of the close adhesion between the toner T and blank paper beyond what is required is prevented. This embodiment facilitates fixing at low temperature that allows for shortening of the warp-up time and improved energy saving characteristics. In addition, because thermal motion to the intermediate transfer member can be controlled, the durability thereof can be improved. In addition, the temperature of the intermediate transfer can be lowered and thermal deterioration at the intermediate transfer member side can be suppressed. As is described above, the fixing device 12 itself of this embodiment comprises a function for transferring the non-fixed toner image and, compared with conventional fixing devices which simple heat and pressurize the blank paper in which a non-fixed toner image is supported, constitutes a "transfer-type fixing device".

Figure 17:
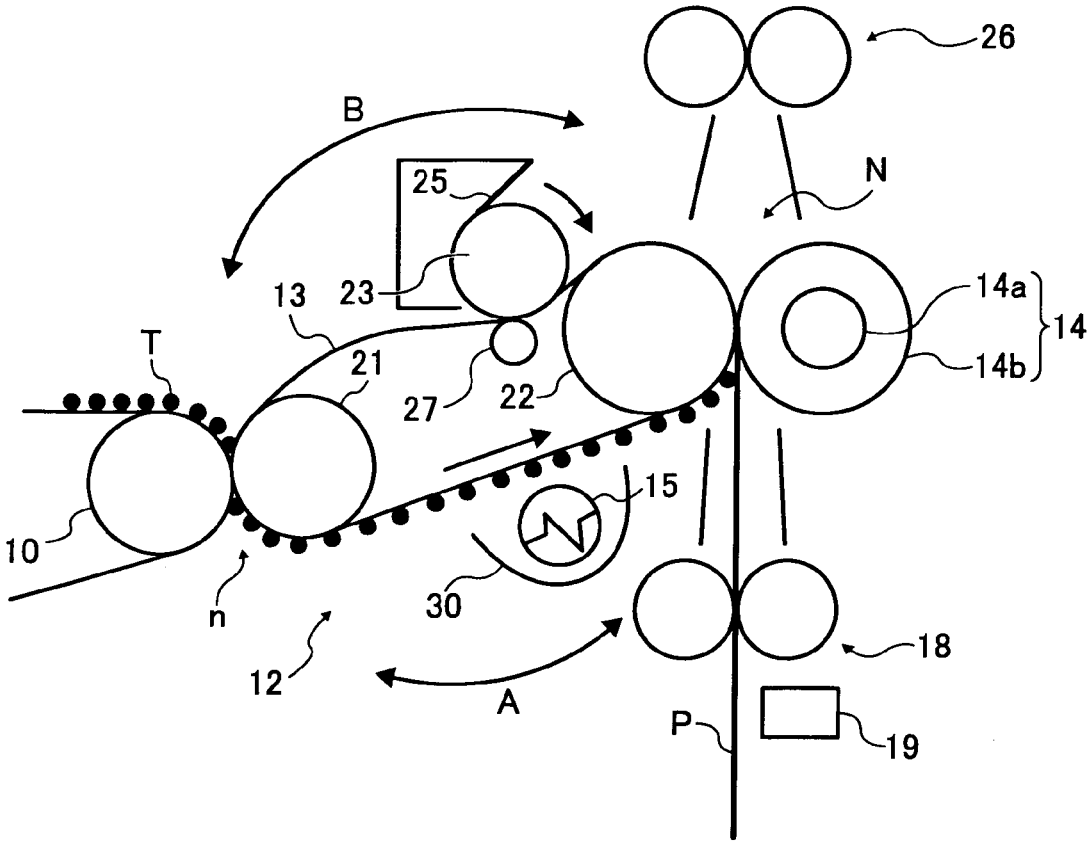
FIG. 17 is a diagram showing an example configuration of this color copier that eliminates shock jitter arising when the blank paper is advanced into a nip portion.

FIG. 17 shows an example configuration for alleviating shock jitter when the blank paper is advanced into a nip portion. The symbols in this diagram correspond to those used in FIG. 16.

The suspended transfer fixing belt 13 is rotationally driven in the anticlockwise direction in the diagram by the transfer fixing roller 22 rotated by a drive motor not shown in the diagram. The cleaning roller 23 and pressure roller 27 are provided in a space (B region in FIG. 16) from the fixing nip portion N to the secondary transfer nip portion n in the direction of rotation of the belt. The cleaning roller 23 is driven in the same direction as the direction of movement of the belt at a belt contact part thereof, the speed thereof being set by the transfer fixing roller 22 to a speed: V' higher than a drive line speed: V of transfer fixing belt 13. The pressure roller 27 is provided to generate a suitable pressure force for dealing with frictional force toward the downstream side in the movement direction produced as a result of the line speed difference of the transfer fixing belt 13 with the transfer fixing roller 23, and revolves accompanying the movement of the transfer fixing belt 13. While not shown in the diagram, in accordance with need a member such as a spring can be employed to generate this pressure force. In addition, replacing the pressure roller 27, elastic pushing by means of a fixed contact member (for example, plate spring) of sufficiently small frictional force is also possible. The residual toner on transfer fixing belt 13 is transferred to the cleaning roller 23 and is scraped off and recovered by the scraper 25. The circumferential length of the transfer fixing belt 13 is set slightly longer than the length of a inner side connecting line of the two roller pairs.

Based on this configuration, the transfer fixing belt 13, while being rotationally driven, is paid out faster at the position of the cleaning roller 23 than anywhere else and, as a result, a slight sag is formed in the section B between the cleaning roller 23 and the secondary transfer roller 21. When the blank paper P is advanced into the fixing nip portion N an increase in the load for opening up the fixing roller pair under high pressure occurs and, momentarily, the rotational speed of the transfer fixing roller 22 is slowed. Accordingly, a speed difference with the secondary transfer roller 21 is generated and shock jitter is produced.

In this embodiment, even if the rotational speed of the transfer fixing roller 22 slows due to the motion forward of the blank paper, the sag between the cleaning roller 23 and the secondary transfer roller 21 absorbs the difference in belt pay out amount with the secondary transfer roller 21. As a result, diffusion of shock jitter to the secondary transfer portion the primary transfer portion by way of the intermediate transfer belt can be prevented. In this embodiment the secondary transfer roller 21 may be revolved by the driven transfer fixing roller 22 by way of a belt, and an overrun clutch may be provided in the secondary transfer roller 21 driven at substantially the same speed.

Figure 18:
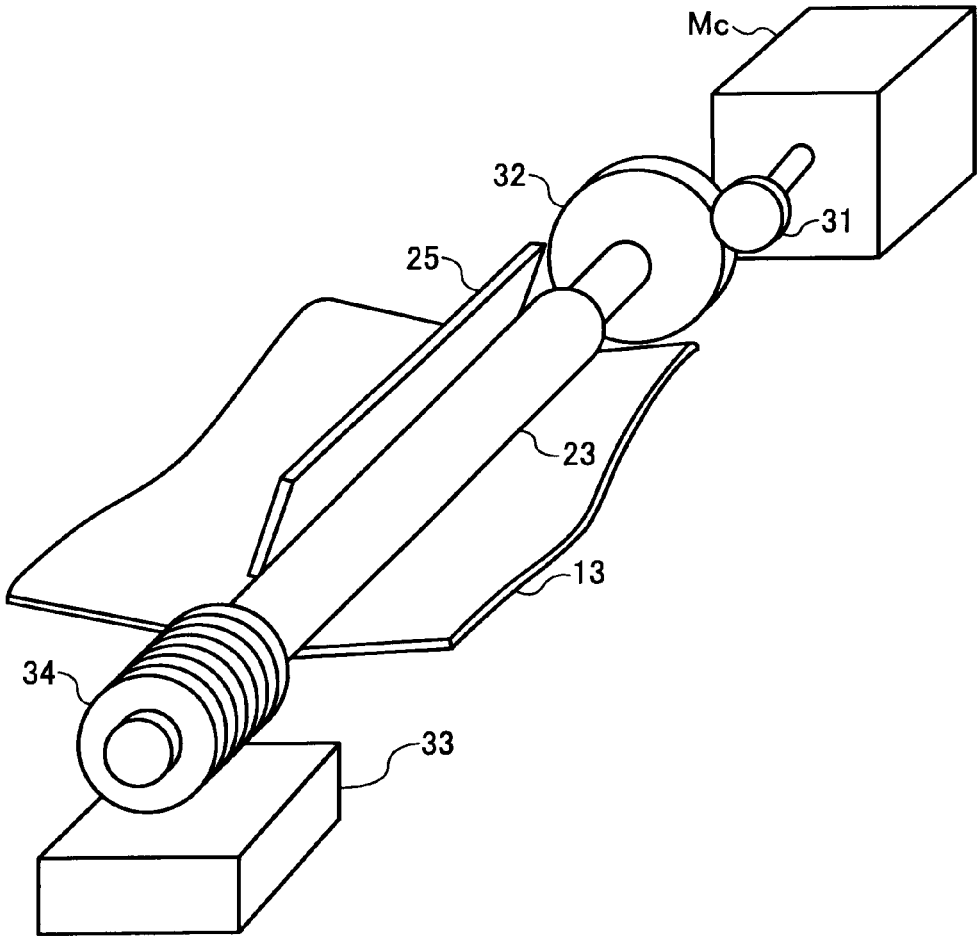
FIG. 18 is a diagram showing an example configuration of this color copier in which a cleaning roller serves as a cooling roller.

FIG. 18 shows an example configuration in which the cleaning roller serves as a cooler roller. The symbol 31 in the diagram denotes a motor gear, 32 denotes a driven gear, 33 denotes a cooling fan, 34 denotes a cooling fin, and Mc denotes a cleaning motor.

In this transfer fixing method the heat of the heated transfer fixing belt diffuses through secondary transfer to the intermediate transfer belt 13 and further diffuses to the photoconductive drum resulting in an increase in the temperature of the photoconductive drum 3 to a temperature above that of a conventional method which, in turn, leads to a deterioration in development and transfer of the toner image. To prevent this problem the diffusion of heat must be prevented and, in this present invention, a configuration in which a cooling roller serving jointly as the cleaning roller 23 is provided beyond the transfer fixing nip portion N is adopted.

The driving gear 32 is fixed to a shaft end portion of the cleaning roller 23 and, engaging with the motor gear 31, the drive force of the cleaning motor Mc is transferred to rotate the cooling roller. In a configuration in which the cooling roller serves jointly as the cleaning roller 23, the scraper 25 is provided to scrape and recover the residual toner transferred from the transfer fixing belt 13. The cooling roller is configured from a metal of good heat transfer characteristics such as copper or aluminium, the cooling fin 34 being provided in the other end portion of the roller shaft and the heat thereof being radiated by the cooling fan 33.

Figure 19:
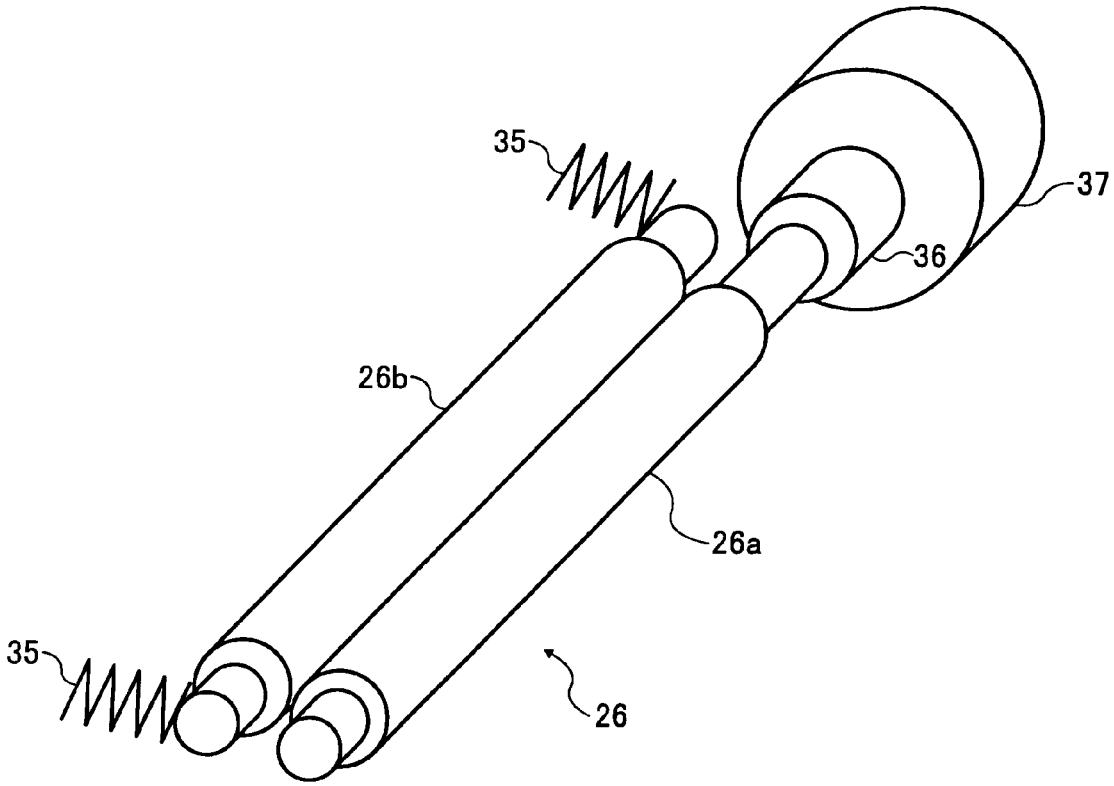
FIG. 19 is a diagram showing the configuration of a discharge roller of this color copier.

FIG. 19 shows the configuration of the discharge rollers. The symbol 35 in the diagram denotes a spring, 36 denotes a coupling, and 37 denotes an electromagnetic brake. A discharge roller **26*b* is pressured at both ends toward the discharge roller 26*a* by springs 35 by way of a bearing (not shown in the diagram). The discharge roller comprises a surface layer of high friction coefficient such as a rubber material surface layer of urethane, EPDM or silicon or the like or a metal to which a metal powder or ceramic or the like has been adhered or fused or the surface has been roughened. The electromagnetic brake 37 is coupled by way of the coupling 36 to the shaft end of the discharge roller 26*a* and applies a brake torque action in response to an input voltage. Subsequent to voltage being imparted to the electromagnetic brake when the blank paper P goes into the discharge roller pair 26 and the discharge roller pair 26** are caused to revolve by the carry force of the blank paper P, a brake torque action is applied to slow the carry speed of the blank paper.

A description of the blank paper passing through the fixing nip portion N will be given with reference to FIG. 20 and FIG. 21.

Figure 20:
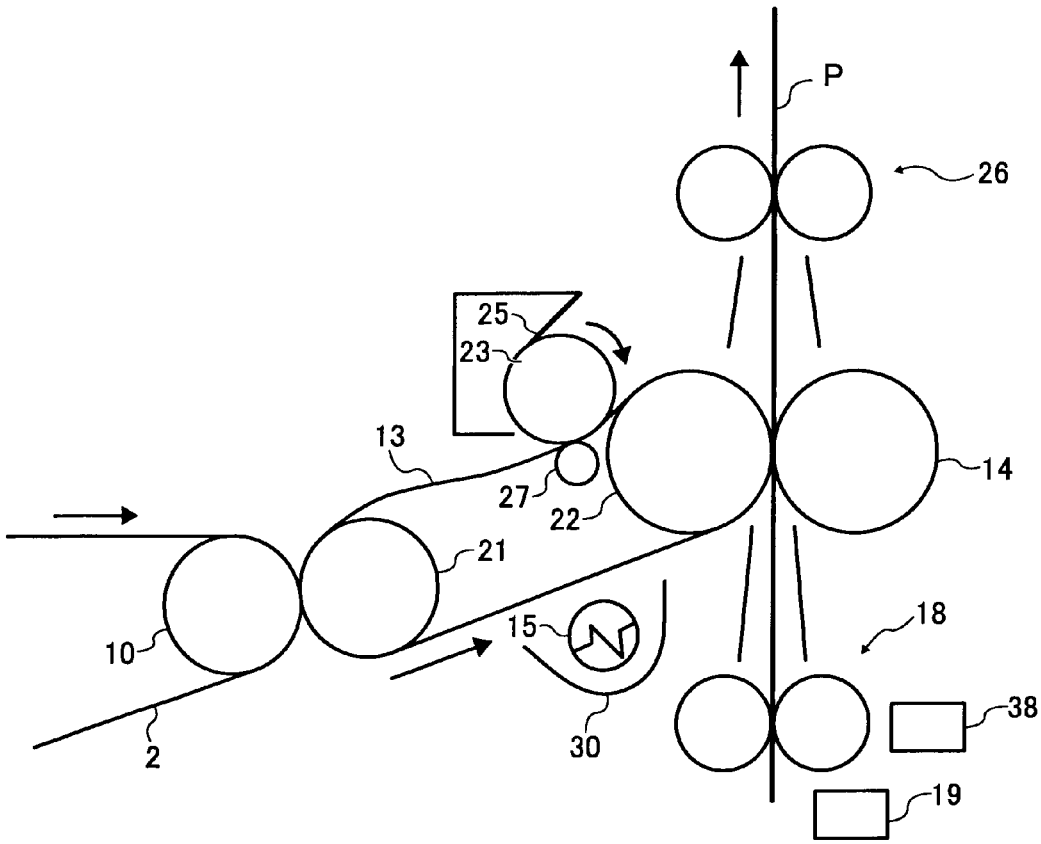
FIG. 20 is a diagram of the state that exists when the rear end of the blank paper passes through a register sensor.

FIG. 20 shows the rear end of the blank paper passing through the register sensor. The symbol 38 in the diagrams denotes a paper thickness sensor.

The diagram shows the front end of the paper passing though the fixing nip portion N and the discharge roller and the rear end passing through the resist sensor. The paper thickness sensor 38 is provided in the pressure-side roller of the resist roller pair 18. The paper thickness sensor 38 comprises a laser displacement gauge, eddy current displacement gauge and contact displacement gauge, and the paper thickness is measured by calculation of the pressure-side roller displacement amount when the blank paper P goes into the register roller pair 18. When the blank paper P is carried, the rear end of the blank paper is detected by the resist sensor 19, and the paper thickness of the blank paper P is detected as is passes though the resist roller 18. At this time, after passing through the fixing nip portion N, the blank paper P is pinched and carried by the discharge roller pair 26. At this time the electromagnetic brake 37 coupled to the discharge roller pair 26 is in the voltage OFF state, and the discharge roller pair 26 is revolved by the carry force of the blank paper P. The carry force of the blank paper P is produced from the drive force of the transfer fixing roller 22 of the fixing nip portion N.

Figure 21:
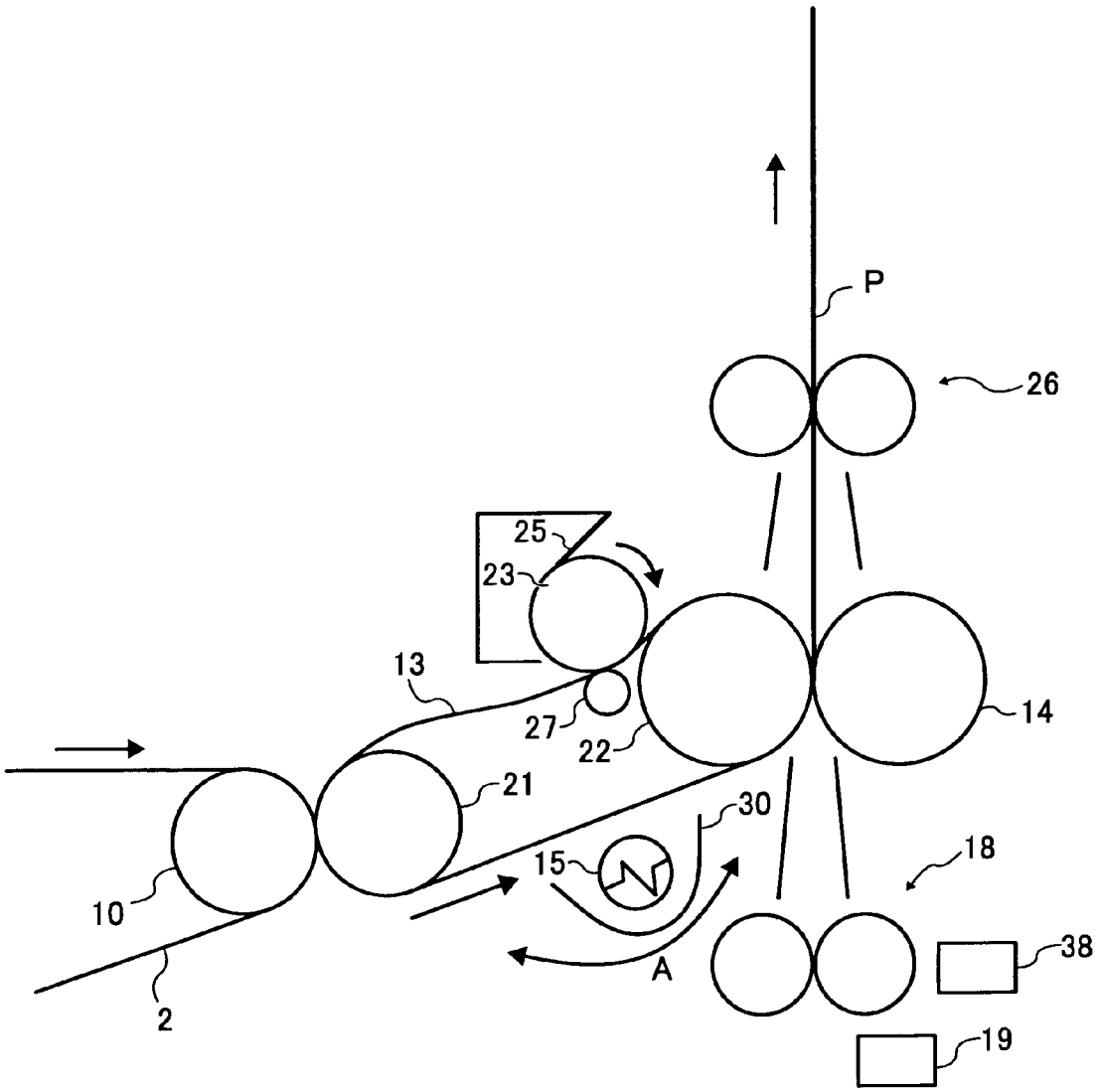
FIG. 21 is a diagram of the rear end of the blank paper passing through a fixing nip portion.

FIG. 21 shows the rear end of the blank paper passing through the fixing nip portion.

The timing of the passing of the rear end of the blank paper P is measured from the detected timing of the resist sensor 19, and voltage is imparted to the electromagnetic brake 37 at this timing resulting in the action of a brake torque on the discharge roller pair 26 and a slowing of the carry speed of the blank paper P. When the rear end of the blank paper comes out of the fixing nip portion N where it is subjected to a high surface pressure, the load for pinching and carrying the blank paper P is released from the drive force of the transfer fixing roller 32 and, accordingly, the speed of the transfer fixing belt 13 temporarily increases. By slowing the blank paper P at this timing, the speed fluctuation of the transfer fixing belt 13 due to the resiliency of the blank paper P can be suppressed as the blank paper comes out of the nip portion. Accordingly, the diffusion of speed fluctuation from the A region of the upstream side of the transfer fixing belt 13 to the secondary transfer portion and the primary transfer portion by way of the intermediate transfer belt 2 resulting in the generation of shock jitter in the toner image can be prevented.

Furthermore, the voltage imparted to the electromagnetic brake 37 is altered in response to the thickness of the blank paper P detected by the paper thickness sensor 38. In other words, the thicker the paper the greater the voltage imparted to increase the brake torque on the t discharge roller pair 26 whereupon, accordingly, large speed fluctuation that occurs with extra thick paper can be precisely suppressed.

When the method of controlling the imparted voltage is digitally controlled by a simple ON/OFF means it is difficult to ensure coincidence between the timing at which the rear end of the blank paper comes out from the transfer nip portion N and the timing at which the voltage is imparted to the electromagnetic brake 37 and, when lag between the timings occurs, speed fluctuation cannot be suppressed. Thereupon, an analog method of control is adopted in which, even through the control itself is a digital control, prior to the timing at which the blank paper comes out the imparted voltage is gradually increased to gradually decrease the rotation of the discharge roller pair and, beyond a calculated timing at which the blank paper would be expected to have come out, the imparted voltage is gradually decreased to gradually increase the rotation of the discharge roller pair. By adopting this method the need for precise synchronization of the timings is eliminated and speed fluctuation can be suppressed even when lag between these timings occurs.

Replacing an electromagnetic brake, the rotation control of this discharge roller pair 26 may be based on connection with a drive source such as a motor.

Figure 22:
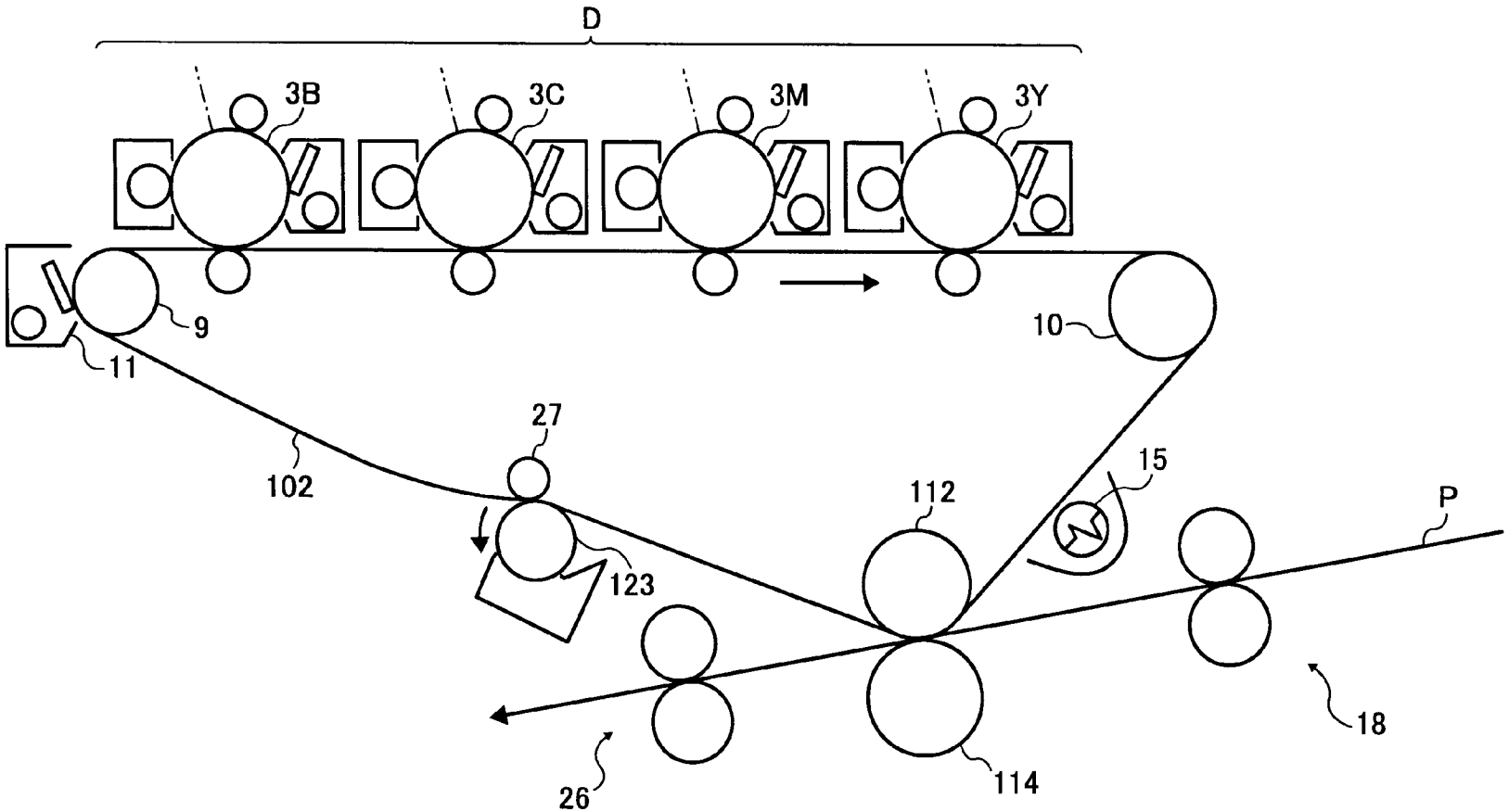
FIG. 22 is a diagram of the secondary transfer fixing performed in this embodiment.

FIG. 22 shows one example of a secondary transfer fixing device. The symbol 102 in the diagram denotes a transfer fixing belt, 112 denotes a transfer fixing roller, 114 denotes a pressure roller, and 123 denotes a cleaning roller.

The toner image primary transferred onto the transfer fixing belt 102 is heated by the halogen heater 15 and secondary transferred and fixed onto the recording medium P at a transfer fixing portion formed by the transfer fixing roller 112 and pressure roller 114. The recording medium P is discharged to the exterior of the apparatus by the discharge roller pair 26.

While the description given hitherto with reference to the diagrams pertains to an embodiment for tertiary transfer fixing, as shown in FIG. 22, application of the present invention in secondary transfer fixing is also possible. In a word, because the present invention is applicable to transfer nip portions where, in the end, the transfer is performed onto the recording medium P, this transfer is possible irrespective of whether a secondary transfer fixing or a tertiary transfer fixing is being performed.

While the transfer onto the recording medium P described above is in all cases described with reference to a transfer fixing configuration, the method of fixing is not restricted to the method outlined in the embodiments above and, accordingly, the use of a discharge roller paper serving additionally as a fixing roller without employing the halogen heater 15 is also possible.

Based on the second embodiment as described above, even if a speed fluctuation (temporary slowing of speed of the belt) occurs when the blank paper (particularly extra thick paper) advances into and is held in the fixing nip portion, because a section of deflection is produced in the belt by a roller rotated at high speed in the downstream side of the fixing nip portion, transfer of the speed fluctuation to the section where the image on the image carrier is transferred is absorbed by the belt defection on the upstream side thereof and, accordingly, shock jitter when the front end of the blank paper advances into the transfer nip portion can be satisfactorily avoided. Furthermore, by controlling the rotational speed of the discharge roller for pinching the blank paper beyond the transfer nip part portion, speed fluctuation (temporary slowing of the belt speed) that occurs when the rear end of the blank paper comes out of the nip portion can be suppressed and, in turn, shock jitter can be avoided.

Various modifications will become possible for those skilled in the art after receiving the teachings of the present disclosure without departing from the scope thereof.

What is claimed is:

1. An image transfer device, comprising:

an image carrier configured to carry an image and configured to primarily transfer the image at a first transfer nip onto an endless belt, the endless belt being supported by a first support member at the first transfer nip; and a secondary transfer member that is configured to secondarily transfer the image at a second transfer nip, the endless belt being supported by a second support member at the second transfer nip, wherein a portion of the endless belt that extends from a first contact point on the first support member to a second contact point on the second support member includes a deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point, and wherein the endless belt is arranged in the image transfer device so as to be individually driven at the first transfer nip and the second transfer nip.

2. The image transfer device as claimed in claim 1, wherein the second transfer nip is formed between the endless belt and the secondary transfer member such that the secondary transfer member is configured to secondarily transfer the image on the endless belt onto a recording medium passing through the second transfer nip.

3. The image transfer device as claimed in claim 1, wherein a heating apparatus that is configured to heat the image on the endless belt is provided around the endless belt, and the secondary transfer member is configured to transfer and fix the image heated by the heating apparatus onto a recording medium.

4. The image transfer device as claimed in claim 1, wherein the secondary transfer member is configured to secondarily transfer the image on the endless belt at the second transfer nip.

5. The image transfer device as claimed in claim 1, wherein the image carrier comprises an imaging apparatus that is configured to form images on a drum-shaped or belt-shaped image carrier.

6. The image transfer device as claimed in claim 1, wherein the image carrier comprises an intermediate transfer member, and wherein the intermediate transfer member is drum-shaped or belt-shaped.

7. The image transfer device as claimed in claim 1, wherein the endless belt comprises a seam.

8. The image transfer device as claimed in claim 1, wherein one of the first or second support members comprises a roller and a drive source configured to move the endless belt by driving the roller.

9. The image transfer device as claimed in claim 8, wherein the drive source is configured to be driven so that a first speed at which the endless belt is moved at the second transfer nip is faster than a second speed at which the endless belt is moved at the first transfer nip.

10. The image transfer device as claimed in claim 8, further comprising:

a deflection amount determination device configured to determine a deflection amount of the endless belt; and a drive control device configured to perform feedback control of the drive source in accordance with an output signal of the deflection amount determination device.

11. The image transfer device as claimed in claim 8, further comprising:

a recording medium detection device configured to detect a recording medium passing through the second transfer nip; and a drive control device configured to perform feedback control of the drive source in accordance with an output signal of the recording medium detection device.

12. The image transfer device as claimed in claim 11, wherein when the recording medium is detected by the recording medium detection device, a first speed at which the endless belt is moved at the first transfer nip is made equal to a second speed at which the endless belt is moved at the secondary transfer nip, or the second speed is made slower than the first speed.

13. The image transfer device as claimed in claim 1, further comprising a drive source configured to move the endless belt supported by one of the first or second support members with a drive force that is transmitted from an exterior of the endless belt, wherein the drive source is provided externally of the endless belt.

14. The image transfer device as claimed in claim 13, wherein the drive source is configured to drive the endless belt so that a first speed at which the endless belt is moved at the second transfer nip is faster than a second speed at which the endless belt is moved at the first transfer nip.

15. The image transfer device as claimed in claim 13, further comprising:

a deflection amount determination device configured to determine a deflection amount of the endless belt; and a drive control device configured to perform feedback control of the drive source in accordance with an output signal of the deflection amount determination device.

16. The image transfer device as claimed in claim 13, further comprising:

a recording medium detection device configured to detect a recording medium passing through the second transfer nip; and a drive control device configured to perform feedback control of the drive source in accordance with an output signal of the recording medium detection device.

17. The image transfer device as claimed in claim 16, wherein when the recording medium is detected by the recording medium detection device, a first speed at which the endless belt is moved at the first transfer nip is made equal to a second speed at which the endless belt is moved at the secondary transfer nip, or the second speed is made slower than the first speed.

18. The image transfer device as claimed in claim 1, wherein the endless belt comprises a three-layer structure configured from a polyimide or metal base layer, a silicon rubber layer on this base layer, and a fluorine resin upper layer.

19. An image transfer device, comprising:

an image carrier configured to carry an image and configured to primarily transfer the image at a first transfer nip onto an endless belt, the endless belt being supported by a first support member at the first transfer nip; and a secondary transfer member that is configured to secondarily transfer the image at a second transfer nip, the endless belt being supported by a second support member at the second transfer nip, wherein the endless belt is configured to be driven such that a deflection portion is generated in the endless belt between the first transfer nip and the second transfer nip to prevent torque fluctuation generated at one of the first and second transfer nip when the endless belt is moved from affecting the other of the first and second transfer nip, and wherein a portion of the endless belt that extends from a first contact point on the first support member to a second contact point on the second support member includes the deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point.

20. The image transfer device as claimed in claim 19, wherein the endless belt comprises a three-layer structure configured from a polyimide or metal base layer, a silicon rubber layer on this base layer, and a fluorine resin upper layer.

21. An image transfer device, comprising:

an image carrier configured to carry an image and configured to primarily transfer the image at a first transfer nip onto an endless belt, the endless belt being supported by a first support member at the first transfer nip; and a secondary transfer member that is configured to secondarily transfer the image at a second transfer nip, the endless belt being supported by a second support member at the second transfer nip, wherein the endless belt is configured to be driven such that a deflection portion is generated in the endless belt between the first transfer nip and the second transfer nip to an extent that torque fluctuation generated at one transfer nip when the endless belt is moved can be absorbed, and wherein a portion of the endless belt that extends from a first contact point on the first support member to a second contact point on the second support member includes a deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point.

22. The image transfer device as claimed in claim 21, wherein the endless belt comprises a three-layer structure configured from a polyimide or metal base layer, a silicon rubber layer on this base layer, and a fluorine resin upper layer.

23. An image transfer device, comprising:

an image carrier configured to carry an image and configured to primarily transfer the image at a first transfer nip onto an endless belt, the endless belt being supported by a first support member at the first transfer nip; and a secondary transfer member that is configured to secondarily transfer the image at a second transfer nip, the endless belt being supported by a second support member at the second transfer nip, wherein the endless belt is configured to be driven such that a first belt length of the endless belt between one of the first and second transfer nip and the other of the first and second transfer nip is varied at the upstream side and downstream side of the first and second transfer nips in a direction of movement of the endless belt so as to generate a deflection portion between the first transfer nip and the second transfer nip to an extent that torque fluctuation generated at one of the first and second transfer nip when the endless belt is moved can be absorbed, and wherein a portion of the endless belt that extends from a first contact point on the first support member to a second contact point on the second support member includes the deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point.

24. The image transfer device as claimed in claim 23, wherein the endless belt comprises a three-layer structure configured from a polyimide or metal base layer, a silicon rubber layer on this base layer, and a fluorine resin upper layer.

25. An image forming apparatus having an image transfer device, comprising:

an image carrier configured to carry an image and configured to primarily transfer the image at a first transfer nip onto an endless belt, the endless belt being supported by a first support member at the first transfer nip; and a secondary transfer member that is configured secondarily transfer the image at a second transfer nip, the endless belt being supported by a second support member at the second transfer nip, wherein a portion of the endless belt that extends from a first contact point on the first support member to a second contact point on the second support member includes a deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point, and wherein the endless belt is arranged in the image transfer device so as to be individually driven at the first transfer nip and the second transfer nip.

26. The image forming apparatus as claimed in claim 25, wherein the image carrier is configured to primarily transfer the image carried by the image carrier onto the endless belt at the first transfer nip, and the endless belt is configured to secondarily transfer the image carried by the endless belt onto a recording medium at the second transfer nip.

27. The image forming apparatus as claimed in claim 25, wherein the image carrier is configured to primarily transfer the image carried by the image carrier onto the endless belt at the first transfer nip, and the endless belt is configured to secondarily transfer the image carried by the endless belt onto the secondary transfer member at the second transfer nip.

28. The image forming apparatus as claimed in claim 25, wherein a heating apparatus that is configured to heat the image on the endless belt is provided around the endless belt, and the secondary transfer member is configured to transfer and fix the image heated by the heating apparatus onto a recording medium.

29. A method of image transfer comprising the steps of:

forming a first transfer nip between an endless belt and an image carrier;

forming a second transfer nip between the endless belt and a transfer member;

driving a first roller and a second roller that respectively support the endless belt at the first transfer nip and the second transfer nip and that each drive the endless belt with a drive source so as to respectively move the endless belt at each of the first transfer nip and the second transfer nip individually;

varying a first speed at which the endless belt is moved at the first transfer nip and a second speed at which the endless belt is moved at the second transfer nip to generate a deflection portion in the endless belt between the first transfer nip and the second transfer nip;

performing a primary transfer, at the first transfer nip, of an image carried by the image carrier onto the endless belt; and performing a secondary transfer, at a second transfer nip, of the image carried by the endless belt, wherein a portion of the endless belt that extends from a first contact point on the first roller to a second contact point on the second roller includes the deflection portion, wherein the endless belt makes direct contact with the first roller at the first contact point, the endless belt makes direct contact with the second roller at the second contact point and the portion of the endless belt is free of direct contact with any rollers between the first contact point and the second contact point, and wherein the deflection portion includes a bulge so as to be offset from a straight line that extends between the first contact point and the second contact point.

30. A method of image transfer comprising the steps of:

forming a first transfer nip between an endless belt and an image carrier;

forming a second transfer nip between the endless belt and a transfer member;

driving a roller that supports the endless belt and that drives the endless belt with a drive source so as to move the endless belt at either the first transfer nip or the second transfer nip;

transmitting a drive force from an exterior of the endless belt by an external drive source so as to move the endless belt at either the first transfer nip or the second transfer nip so as to vary a first speed at which the endless belt is moved at the first transfer nip and a second speed at which the endless belt is moved at the second transfer nip, and generate a deflection portion in the endless belt between the first transfer nip and the second transfer nip;

performing a primary transfer, at the first transfer nip, of an image carried by the image carrier onto the endless belt, the endless belt being supported by one of the roller or a support member at the first transfer nip; and performing a secondary transfer, at the second transfer nip, of the image carried by the endless belt, the endless belt being supported by the other of the roller or the support member at the second transfer nip, wherein a portion of the endless belt that extends from a first contact point on the roller to a second contact point on the support member includes the deflection portion, wherein the endless belt makes direct contact with the roller at the first contact point, the endless belt makes direct contact with the support member at the second contact point and the portion of the endless belt is free of direct contact with any support members between the first contact point and the second contact point, and wherein the deflection portion includes a bulge so as to be offset from a straight line that extends between the first contact point and the second contact point.

31. A method of image transfer comprising the steps of:

forming a first transfer nip between an endless belt and an image carrier;

forming a second transfer nip between the endless belt and a transfer member;

transmitting a drive force from an exterior of the endless belt by an external drive source so as to move the endless belt at each of the first transfer nip and the second transfer nip individually;

varying a first speed at which the endless belt is moved at the first transfer nip and a second speed at which the endless belt is moved at the second transfer nip to generate a deflection portion in the endless belt between the first transfer nip and the second transfer nip;

performing a primary transfer, at the first transfer nip, of an image carried by the image carrier onto the endless belt, the endless belt being supported by a first support member at the first transfer nip; and performing a secondary transfer of the image carried by the endless belt at the secondary transfer nip position, the endless belt being supported by a second support member at the second transfer nip, wherein a portion of the endless belt that extends from a first contact point on the first support member to a second contact point on the second support member includes the deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point.

32. A method of forming a deflection portion that is free of direct contact with any support members in an endless belt supported by a support member between a primary transfer nip position and a secondary transfer nip position of an image transfer device, the method comprising:

varying a first speed at which the endless belt is moved at the primary first transfer nip position and a second speed at which the endless belt is moved at the secondary transfer nip position so as to form the deflection portion in the endless belt, the endless belt being supported by a first support member at the primary transfer nip position, and the endless belt being supported by a second support member at the secondary transfer nip position, wherein a portion of the endless belt that extends from a first contact point on the first support member to a second contact point on the second support member includes the deflection portion, wherein the endless belt makes direct contact with the first support member at the first contact point, the endless belt makes direct contact with the second support member at the second contact point and the portion of the endless belt is free of direct contact with any support members between the first contact point and the second contact point, and wherein the deflection portion includes a bulge so as to be offset from a straight line that extends between the first contact point and the second contact point.

* * * * *